US011058914B2

(12) United States Patent
Powell

(10) Patent No.: US 11,058,914 B2
(45) **Date of Patent: *Jul. 13, 2021**

(54) COOLING METHODS FOR EXERCISE EQUIPMENT

(71) Applicant: ICON Health & Fitness, Inc., Logan, UT (US)

(72) Inventor: Wade A. Powell, Millville, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 112 days.

This patent is subject to a terminal disclaimer.

(21) Appl. No.: 16/422,414

(22) Filed: May 24, 2019

(65) Prior Publication Data

US 2019/0275366 A1 Sep. 12, 2019

Related U.S. Application Data

(63) Continuation of application No. 15/785,302, filed on Oct. 16, 2017, now Pat. No. 10,441,844, which is a (Continued)

(51) Int. Cl.
*A63B 22/02* (2006.01)
*A63B 22/06* (2006.01)
(Continued)

(52) U.S. Cl.
CPC ..... *A63B 22/0257* (2013.01); *A63B 21/154* (2013.01); *A63B 22/025* (2015.10); *A63B 22/0235* (2013.01); *A63B 24/0087* (2013.01); *A63B 21/0055* (2015.10); *A63B 21/0057* (2013.01); *A63B 21/0088* (2013.01); *A63B 21/225* (2013.01); *A63B 22/0023* (2013.01); (Continued)

(58) Field of Classification Search
CPC ..... A63B 22/02–0292; A63B 9/0028–0035
See application file for complete search history.

(56) References Cited

U.S. PATENT DOCUMENTS 3,123,646 A 3/1964 Easton
3,579,339 A 5/1971 Chang
(Continued)

FOREIGN PATENT DOCUMENTS

CN 100354017 12/2007
KR 20050087181 8/2005
(Continued)

OTHER PUBLICATIONS

U.S. Appl. No. 13/088,007, filed Apr. 15, 2011, Scott R. Watterson.
(Continued)

*Primary Examiner* — Nyca T Nguyen
(74) *Attorney, Agent, or Firm* — Ray Quinney & Nebeker P.C.; Paul N. Taylor

(57) ABSTRACT

A method for cooling a motor on a treadmill includes rotating a flywheel with a drive motor. A ring member coupled to the flywheel is be rotated with the flywheel. A pressure drop is generated in an annulus of the ring member between the drive motor and a lift motor. Intake air is drawn in a first direction across the lift motor toward the pressure drop.

19 Claims, 12 Drawing Sheets

Related U.S. Application Data continuation-in-part of application No. 15/639,935, filed on Jun. 30, 2017, now Pat. No. 10,471,299.

(60) Provisional application No. 62/357,815, filed on Jul. 1, 2016.

(51) Int. Cl.

| | |
|---|---|
| ***A63B 22/00*** | (2006.01) |
| ***A63B 21/00*** | (2006.01) |
| ***A63B 24/00*** | (2006.01) |
| *A63B 21/22* | (2006.01) |
| *A63B 71/06* | (2006.01) |
| *A63B 21/008* | (2006.01) |
| *A63B 21/005* | (2006.01) |

(52) U.S. Cl.

CPC ..... *A63B 22/0076* (2013.01); *A63B 22/02* (2013.01); *A63B 22/0605* (2013.01); *A63B 22/0664* (2013.01); *A63B 2024/009* (2013.01); *A63B 2071/068* (2013.01); *A63B 2071/0638* (2013.01); *A63B 2071/0683* (2013.01); *A63B 2225/30* (2013.01); *A63B 2230/06* (2013.01)

(56) References Cited

U.S. PATENT DOCUMENTS 4,023,795 A 5/1977 Pauls
4,300,760 A 11/1981 Bobroff
D286,311 S 10/1986 Martinell et al.
4,681,318 A 7/1987 Lay
4,684,126 A 8/1987 Dalebout et al.
4,728,102 A 3/1988 Pauls
4,750,736 A 6/1988 Watterson
4,796,881 A 1/1989 Watterson
4,813,667 A 3/1989 Watterson
4,830,371 A 5/1989 Lay
4,844,451 A 7/1989 Bersonnet
4,850,585 A 7/1989 Dalebout
D304,849 S 11/1989 Watterson
4,880,225 A 11/1989 Lucas
4,883,272 A 11/1989 Lay
D306,468 S 3/1990 Watterson
D306,891 S 3/1990 Watterson
4,913,396 A 4/1990 Dalebout
D307,614 S 5/1990 Bingham et al.
D307,615 S 5/1990 Bingham et al.
4,921,242 A 5/1990 Watterson
4,932,650 A 6/1990 Bingham et al.
D309,167 S 7/1990 Griffin
D309,485 S 7/1990 Bingham et al.
4,938,478 A 7/1990 Lay
D310,253 S 8/1990 Bersonnet et al.
4,955,599 A 9/1990 Bersonnet et al.
4,971,316 A 11/1990 Dalebout et al.
D313,055 S 12/1990 Watterson
4,974,832 A 12/1990 Dalebout
4,979,737 A 12/1990 Kock
4,981,294 A 1/1991 Dalebout et al.
D315,765 S 3/1991 Measom et al.
4,998,725 A 3/1991 Watterson et al.
5,000,442 A 3/1991 Dalebout et al.
5,000,443 A 3/1991 Dalebout et al.
5,000,444 A 3/1991 Dalebout et al.
D316,124 S 4/1991 Dalebout et al.
5,013,033 A 5/1991 Watterson et al.
5,014,980 A 5/1991 Bersonnet et al.
5,016,871 A 5/1991 Dalebout et al.
D318,085 S 7/1991 Jacobson et al.
D318,086 S 7/1991 Bingham et al.
D318,699 S 7/1991 Jacobson et al.
5,029,801 A 7/1991 Dalebout et al.
5,034,576 A 7/1991 Dalebout et al.
5,058,881 A 10/1991 Measom
5,058,882 A 10/1991 Dalebout et al.
D321,388 S 11/1991 Dalebout
5,062,626 A 11/1991 Dalebout et al.
5,062,627 A 11/1991 Bingham
5,062,632 A 11/1991 Dalebout et al.
5,062,633 A 11/1991 Engel et al.
5,067,710 A 11/1991 Watterson et al.
5,072,929 A 12/1991 Peterson et al.
D323,009 S 1/1992 Dalebout et al.
D323,198 S 1/1992 Dalebout
D323,199 S 1/1992 Dalebout et al.
D323,863 S 2/1992 Watterson
5,088,729 A 2/1992 Dalebout
5,090,694 A 2/1992 Pauls et al.
5,102,380 A 4/1992 Jacobson et al.
5,104,120 A 4/1992 Watterson et al.
5,108,093 A 4/1992 Watterson
D326,491 S 5/1992 Dalebout
5,122,105 A 6/1992 Engel et al.
5,135,216 A 8/1992 Bingham et al.
5,147,265 A 9/1992 Pauls et al.
5,149,084 A 9/1992 Dalebout
5,149,312 A 9/1992 Croft et al.
5,171,196 A 12/1992 Lynch
D332,347 S 1/1993 Raadt et al.
5,190,505 A 3/1993 Dalebout
5,192,255 A 3/1993 Dalebout
5,195,937 A 3/1993 Engel et al.
5,203,826 A 4/1993 Dalebout
D335,511 S 5/1993 Engel et al.
D335,905 S 5/1993 Cutter et al.
D336,498 S 6/1993 Engel et al.
5,217,487 A 6/1993 Engel
D337,361 S 7/1993 Engel et al.
D337,666 S 7/1993 Peterson et al.
D337,799 S 7/1993 Cutter et al.
5,226,866 A 7/1993 Engel
5,244,446 A 9/1993 Engel
5,247,853 A 9/1993 Dalebout
5,259,611 A 11/1993 Dalebout et al.
D342,106 S 12/1993 Campbell et al.
5,279,528 A 1/1994 Dalebout et al.
D344,112 S 2/1994 Smith
D344,557 S 2/1994 Ashby
5,282,776 A 2/1994 Dalebout
5,295,931 A 3/1994 Dreibelbis et al.
5,302,161 A 4/1994 Loubert et al.
D347,251 S 5/1994 Dreibelbis et al.
5,316,534 A 5/1994 Dalebout et al.
D348,493 S 7/1994 Ashby
D348,494 S 7/1994 Ashby
5,328,164 A 7/1994 Soga
D349,931 S 8/1994 Bostic et al.
5,336,142 A 8/1994 Dalebout et al.
5,344,376 A 9/1994 Bostic et al.
D351,202 S 10/1994 Bingham
D351,435 S 10/1994 Peterson et al.
D351,633 S 10/1994 Bingham
D352,534 S 11/1994 Dreibelbis et al.
D353,422 S 12/1994 Bostic et al.
5,372,559 A 12/1994 Dalebout et al.
5,374,228 A 12/1994 Buisman et al.
5,382,221 A 1/1995 Hsu et al.
5,387,168 A 2/1995 Bostic
5,393,690 A 2/1995 Fu et al.
D356,128 S 3/1995 Smith et al.
5,409,435 A 4/1995 Daniels
5,429,563 A 7/1995 Engel et al.
5,431,612 A 7/1995 Holden
D360,915 S 8/1995 Bostic et al.
5,468,205 A 11/1995 McFall et al.
5,476,430 A * 12/1995 Lee ..... A63B 22/02 482/3
5,489,249 A 2/1996 Brewer et al.
5,492,517 A 2/1996 Bostic et al.
D367,689 S 3/1996 Wilkinson et al.
5,511,740 A 4/1996 Loubert et al.
5,512,025 A 4/1996 Dalebout et al.
D370,949 S 6/1996 Furner

(56) References Cited

U.S. PATENT DOCUMENTS

D371,176 S 6/1996 Furner
5,527,245 A 6/1996 Dalebout
5,529,553 A 6/1996 Finlayson
5,540,429 A 7/1996 Dalebout et al.
5,549,533 A 8/1996 Olson et al.
5,554,085 A 9/1996 Dalebout
5,569,128 A 10/1996 Dalebout
5,591,105 A 1/1997 Dalebout et al.
5,591,106 A 1/1997 Dalebout et al.
5,595,556 A 1/1997 Dalebout et al.
5,607,375 A 3/1997 Dalebout et al.
5,611,539 A 3/1997 Watterson
5,622,527 A 4/1997 Watterson et al.
5,626,538 A 5/1997 Dalebout et al.
5,626,542 A 5/1997 Dalebout et al.
D380,024 S 6/1997 Novak et al.
5,637,059 A 6/1997 Dalebout
D380,509 S 7/1997 Wilkinson et al.
5,643,153 A 7/1997 Nylen et al.
5,645,509 A 7/1997 Brewer
D384,118 S 9/1997 Deblauw
5,662,557 A 9/1997 Watterson
5,669,857 A 9/1997 Watterson
5,672,140 A 9/1997 Watterson
5,674,156 A 10/1997 Watterson et al.
5,674,453 A 10/1997 Watterson et al.
5,676,624 A 10/1997 Watterson et al.
5,683,331 A 11/1997 Dalebout
5,683,332 A 11/1997 Watterson et al.
D387,825 S 12/1997 Fleck et al.
5,695,433 A 12/1997 Buisman
5,695,434 A 12/1997 Dalebout et al.
5,695,435 A 12/1997 Dalebout et al.
5,702,325 A 12/1997 Watterson et al.
5,704,879 A 1/1998 Watterson et al.
5,718,657 A 2/1998 Dalebout et al.
5,720,200 A 2/1998 Anderson et al.
5,720,698 A 2/1998 Dalebout et al.
D392,006 S 3/1998 Dalebout et al.
5,722,922 A 3/1998 Watterson et al.
5,733,229 A 3/1998 Dalebout et al.
5,743,833 A 4/1998 Watterson et al.
5,762,584 A 6/1998 Daniels
5,762,587 A 6/1998 Dalebout et al.
5,772,560 A 6/1998 Watterson et al.
5,810,698 A 9/1998 Hullett et al.
5,827,155 A 10/1998 Jensen
5,830,114 A 11/1998 Halfen et al.
5,833,577 A * 11/1998 Hurt ..... A63B 22/02 482/54
5,860,893 A 1/1999 Watterson et al.
5,860,894 A 1/1999 Dalebout et al.
5,899,834 A 5/1999 Dalebout et al.
5,921,893 A * 7/1999 Hurt ..... A63B 22/02 482/51
D412,953 S 8/1999 Armstrong
D413,948 S 9/1999 Dalebout
5,951,441 A 9/1999 Dalebout
5,951,448 A 9/1999 Bolland
D416,596 S 11/1999 Armstrong
6,003,166 A 12/1999 Hald et al.
6,019,710 A 2/2000 Dalebout et al.
6,027,429 A 2/2000 Daniels
6,033,347 A 3/2000 Dalebout et al.
D425,940 S 5/2000 Halfen et al.
6,059,692 A 5/2000 Hickman
D428,949 S 8/2000 Simonson
6,123,646 A 9/2000 Colassi
6,171,217 B1 1/2001 Cutler
6,171,219 B1 1/2001 Simonson
6,174,267 B1 1/2001 Dalebout
6,193,631 B1 2/2001 Hickman
6,228,003 B1 5/2001 Hald et al.
6,238,323 B1 5/2001 Simonson
6,251,052 B1 6/2001 Simonson
6,261,022 B1 7/2001 Dalebout et al.
6,280,362 B1 8/2001 Dalebout et al.
6,296,594 B1 10/2001 Simonson
6,300,694 B1 * 10/2001 Wang ..... F04D 25/082 310/62
D450,872 S 11/2001 Dalebout et al.
6,312,363 B1 11/2001 Watterson et al.
D452,338 S 12/2001 Dalebout et al.
D453,543 S 2/2002 Cutler
D453,948 S 2/2002 Cutler
6,350,218 B1 2/2002 Dalebout et al.
6,387,020 B1 5/2002 Simonson
6,413,191 B1 7/2002 Harris et al.
6,422,980 B1 7/2002 Simonson
6,447,424 B1 9/2002 Ashby et al.
6,458,060 B1 10/2002 Watterson et al.
6,458,061 B2 10/2002 Simonson
6,471,622 B1 10/2002 Hammer et al.
6,563,225 B2 5/2003 Soga et al.
6,601,016 B1 7/2003 Brown et al.
6,623,140 B2 9/2003 Watterson
6,626,799 B2 9/2003 Watterson et al.
6,652,424 B2 11/2003 Dalebout
6,685,607 B1 2/2004 Olson
6,695,581 B2 2/2004 Wasson et al.
6,701,271 B2 3/2004 Willner et al.
6,702,719 B1 3/2004 Brown et al.
6,712,740 B2 3/2004 Simonson
6,730,002 B2 5/2004 Hald et al.
6,743,153 B2 6/2004 Watterson et al.
6,746,371 B1 6/2004 Brown et al.
6,749,537 B1 6/2004 Hickman
6,761,667 B1 7/2004 Cutler et al.
6,770,015 B2 8/2004 Simonson
6,786,852 B2 9/2004 Watterson et al.
6,808,472 B1 10/2004 Hickman
6,821,230 B2 11/2004 Dalebout et al.
6,830,540 B2 12/2004 Watterson
6,863,641 B1 3/2005 Brown et al.
6,866,613 B1 3/2005 Brown et al.
6,875,160 B2 4/2005 Watterson et al.
D507,311 S 7/2005 Butler et al.
6,918,858 B2 7/2005 Watterson et al.
6,921,351 B1 7/2005 Hickman et al.
6,942,602 B1 * 9/2005 Barker ..... A63B 22/0235 482/51
6,974,404 B1 12/2005 Watterson et al.
6,997,852 B2 2/2006 Watterson et al.
7,025,713 B2 4/2006 Dalebout
D520,085 S 5/2006 Willardson et al.
7,044,897 B2 5/2006 Myers et al.
7,052,442 B2 5/2006 Watterson
7,060,006 B1 6/2006 Watterson et al.
7,060,008 B2 6/2006 Watterson et al.
7,070,539 B2 7/2006 Brown et al.
7,091,635 B1 * 8/2006 Gilliland ..... F04D 29/282 310/62
7,097,588 B2 8/2006 Watterson
D527,776 S 9/2006 Willardson et al.
7,112,168 B2 9/2006 Dalebout et al.
7,128,693 B2 10/2006 Brown et al.
7,166,062 B1 1/2007 Watterson et al.
7,166,064 B2 1/2007 Watterson et al.
7,169,087 B2 1/2007 Ercanbrack et al.
7,169,093 B2 1/2007 Simonson et al.
7,192,388 B2 3/2007 Dalebout et al.
7,250,022 B2 7/2007 Dalebout
7,282,016 B2 10/2007 Simonson
7,285,075 B2 10/2007 Cutler et al.
7,344,481 B2 3/2008 Watterson et al.
7,377,882 B2 5/2008 Watterson
7,425,188 B2 9/2008 Ercanbrack
7,429,236 B2 9/2008 Dalebout et al.
7,455,622 B2 11/2008 Watterson et al.
7,482,050 B2 1/2009 Olson
D588,655 S 3/2009 Utykanski
7,510,509 B2 3/2009 Hickman
7,537,546 B2 5/2009 Watterson et al.
7,537,549 B2 5/2009 Nelson

(56) References Cited

U.S. PATENT DOCUMENTS 7,537,552 B2 5/2009 Dalebout
7,540,828 B2 6/2009 Watterson et al.
7,549,947 B2 6/2009 Hickman et al.
7,556,590 B2 7/2009 Watterson et al.
7,563,203 B2 7/2009 Dalebout et al.
7,575,536 B1 8/2009 Hickman
7,601,105 B1 10/2009 Gipson, III et al.
7,604,573 B2 10/2009 Dalebout et al.
D604,373 S 11/2009 Dalebout et al.
7,618,350 B2 11/2009 Dalebout et al.
7,618,357 B2 11/2009 Dalebout
7,625,315 B2 12/2009 Hickman
7,625,321 B2 12/2009 Simonson et al.
7,628,730 B1 12/2009 Watterson et al.
7,628,737 B2 12/2009 Kowallis et al.
7,637,847 B1 12/2009 Hickman
7,645,212 B2 1/2010 Ashby et al.
7,645,213 B2 1/2010 Watterson
7,658,698 B2 2/2010 Pacheco et al.
7,674,205 B2 3/2010 Dalebout et al.
7,713,171 B1 5/2010 Hickman
7,713,172 B2 5/2010 Watterson et al.
7,713,180 B2 5/2010 Wickens
7,717,828 B2 5/2010 Simonson et al.
7,736,279 B2 6/2010 Dalebout et al.
7,740,563 B2 6/2010 Dalebout et al.
7,749,144 B2 7/2010 Hammer
7,766,797 B2 8/2010 Dalebout
7,771,329 B2 8/2010 Dalebout et al.
7,775,940 B2 8/2010 Dalebout et al.
7,789,800 B1 9/2010 Watterson et al.
7,798,946 B2 9/2010 Dalebout et al.
7,815,550 B2 10/2010 Watterson et al.
7,857,731 B2 12/2010 Hickman et al.
7,862,475 B2 1/2011 Watterson
7,862,478 B2 1/2011 Watterson et al.
7,862,483 B2 1/2011 Hendrickson et al.
7,887,466 B1 * 2/2011 Chen ..... A63B 21/0053 482/54
D635,207 S 3/2011 Dalebout et al.
7,901,330 B2 3/2011 Dalebout et al.
7,909,740 B2 3/2011 Dalebout et al.
7,980,996 B2 7/2011 Hickman
7,981,000 B2 7/2011 Watterson et al.
7,985,164 B2 7/2011 Ashby
8,007,408 B1 * 8/2011 Moran ..... A63B 22/025 482/54
8,029,415 B2 10/2011 Ashby et al.
8,033,960 B1 10/2011 Dalebout et al.
D650,451 S 12/2011 Olson et al.
D652,877 S 1/2012 Dalebout et al.
8,152,702 B2 4/2012 Pacheco
D659,775 S 5/2012 Olson et al.
D659,777 S 5/2012 Watterson et al.
D660,383 S 5/2012 Watterson et al.
D664,613 S 7/2012 Dalebout et al.
8,251,874 B2 8/2012 Ashby et al.
8,298,123 B2 10/2012 Hickman
8,298,125 B2 10/2012 Colledge et al.
D671,177 S 11/2012 Sip
D671,178 S 11/2012 Sip
D673,626 S 1/2013 Olson et al.
8,690,735 B2 4/2014 Watterson
D707,763 S 6/2014 Cutler
8,740,753 B2 6/2014 Olson
8,758,201 B2 6/2014 Ashby
8,771,153 B2 7/2014 Dalebout et al.
8,784,270 B2 7/2014 Watterson
8,808,148 B2 8/2014 Watterson
8,814,762 B2 8/2014 Butler
D712,493 S 9/2014 Ercanbrack et al.
8,840,075 B2 9/2014 Olson
8,845,493 B2 9/2014 Watterson et al.
8,870,726 B2 10/2014 Watterson et al.
8,876,668 B2 11/2014 Hendrickson et al.
8,894,549 B2 11/2014 Colledge
8,894,555 B2 11/2014 Olson
8,911,330 B2 12/2014 Watterson et al.
8,920,288 B2 12/2014 Dalebout
8,986,165 B2 3/2015 Ashby
8,992,364 B2 3/2015 Law et al.
8,992,387 B2 3/2015 Watterson et al.
D726,476 S 4/2015 Ercanbrack
9,028,368 B2 5/2015 Ashby et al.
9,028,370 B2 5/2015 Watterson
9,039,578 B2 5/2015 Dalebout
D731,011 S 6/2015 Buchanan
9,072,930 B2 7/2015 Ashby et al.
9,119,983 B2 9/2015 Rhea
9,123,317 B2 9/2015 Watterson
9,126,071 B2 9/2015 Smith
9,126,072 B2 9/2015 Watterson
9,138,615 B2 9/2015 Olson et al.
9,142,139 B2 9/2015 Watterson et al.
9,144,703 B2 9/2015 Dalebout et al.
9,149,683 B2 9/2015 Smith
9,186,535 B2 11/2015 Ercanbrack
9,186,549 B2 11/2015 Watterson et al.
9,254,409 B2 2/2016 Dalebout et al.
9,254,416 B2 2/2016 Ashby
9,278,248 B2 3/2016 Tyger
9,278,249 B2 3/2016 Watterson
9,278,250 B2 3/2016 Buchanan
9,289,648 B2 3/2016 Watterson
9,339,691 B2 5/2016 Brammer
9,352,185 B2 5/2016 Hendrickson
9,352,186 B2 5/2016 Watterson
9,375,605 B2 6/2016 Tyger
9,381,394 B2 7/2016 Mortensen et al.
9,387,387 B2 7/2016 Dalebout
9,393,453 B2 7/2016 Watterson
9,403,047 B2 8/2016 Olson
9,403,051 B2 8/2016 Cutler
9,421,416 B2 8/2016 Mortensen et al.
9,457,219 B2 10/2016 Smith
9,457,220 B2 10/2016 Olson
9,457,222 B2 10/2016 Dalebout
9,460,632 B2 10/2016 Watterson
9,463,356 B2 10/2016 Rhea
9,468,794 B2 10/2016 Barton
9,468,798 B2 10/2016 Dalebout
9,480,874 B2 11/2016 Cutler
9,492,704 B2 11/2016 Mortensen et al.
9,498,668 B2 11/2016 Smith
9,517,378 B2 12/2016 Ashby
9,521,901 B2 12/2016 Dalebout
9,533,187 B2 1/2017 Dalebout
9,539,461 B2 1/2017 Ercanbrack
9,579,544 B2 2/2017 Watterson
9,586,086 B2 3/2017 Dalebout et al.
9,586,090 B2 3/2017 Watterson
9,604,099 B2 3/2017 Taylor
9,616,276 B2 4/2017 Dalebout
9,616,278 B2 4/2017 Olson
9,623,281 B2 4/2017 Hendrickson
9,636,567 B2 5/2017 Brammer
9,675,839 B2 6/2017 Dalebout
9,682,307 B2 6/2017 Dalebout
9,694,234 B2 7/2017 Dalebout et al.
9,694,242 B2 7/2017 Ashby
9,737,755 B2 8/2017 Dalebout
9,757,605 B2 9/2017 Olson et al.
9,764,186 B2 9/2017 Dalebout
9,767,785 B2 9/2017 Ashby
9,795,822 B2 10/2017 Smith et al.
9,808,672 B2 11/2017 Dalebout
9,849,326 B2 12/2017 Smith
9,878,210 B2 1/2018 Watterson
9,889,334 B2 2/2018 Ashby et al.
9,889,339 B2 2/2018 Douglass
9,937,376 B2 4/2018 McInelly et al.
9,937,377 B2 4/2018 McInelly et al.
9,937,378 B2 4/2018 Dalebout et al.
9,937,379 B2 4/2018 Mortensen

(56) References Cited

U.S. PATENT DOCUMENTS 9,943,719 B2 4/2018 Smith et al.
9,943,722 B2 4/2018 Dalebout
9,948,037 B2 4/2018 Ashby
9,968,816 B2 5/2018 Olson et al.
9,968,821 B2 5/2018 Finlayson et al.
9,968,823 B2 5/2018 Cutler
10,010,755 B2 7/2018 Watterson
10,010,756 B2 7/2018 Watterson
10,029,145 B2 7/2018 Douglass
D826,350 S 8/2018 Hochstrasser
10,046,196 B2 8/2018 Ercanbrack
D827,733 S 9/2018 Hochstrasser
10,065,064 B2 9/2018 Smith et al.
10,071,285 B2 9/2018 Smith et al.
10,085,586 B2 10/2018 Smith et al.
10,086,254 B2 10/2018 Watterson
10,136,842 B2 11/2018 Ashby
10,186,161 B2 1/2019 Watterson
10,188,890 B2 1/2019 Olson
10,207,143 B2 2/2019 Dalebout
10,207,145 B2 2/2019 Tyger
10,207,147 B2 2/2019 Ercanbrack
10,207,148 B2 2/2019 Powell
10,212,994 B2 2/2019 Watterson
10,220,259 B2 3/2019 Brammer
10,226,396 B2 3/2019 Ashby
10,226,664 B2 3/2019 Dalebout
10,252,109 B2 4/2019 Watterson
10,272,317 B2 4/2019 Watterson
10,279,212 B2 5/2019 Dalebout et al.
10,293,211 B2 5/2019 Watterson et al.
D852,292 S 6/2019 Cutler
10,343,017 B2 7/2019 Jackson
10,376,736 B2 8/2019 Powell et al.
D864,320 S 10/2019 Weston
D864,321 S 10/2019 Weston
10,449,416 B2 10/2019 Dalebout
D868,909 S 12/2019 Cutler et al.
10,492,519 B2 12/2019 Capell et al.
10,500,473 B2 12/2019 Watterson
2002/0016235 A1 2/2002 Ashby et al.
2002/0077221 A1 6/2002 Dalebout et al.
2002/0159253 A1 10/2002 Dalebout et al.
2003/0045406 A1 3/2003 Stone
2003/0139259 A1* 7/2003 Kuo ..... H02K 7/14 482/54
2004/0091307 A1 5/2004 James
2004/0171464 A1 9/2004 Ashby et al.
2004/0171465 A1 9/2004 Hald et al.
2005/0049123 A1 3/2005 Dalebout et al.
2005/0077805 A1 4/2005 Dalebout et al.
2005/0107229 A1 5/2005 Wickens
2005/0164839 A1 7/2005 Watterson et al.
2005/0272577 A1 12/2005 Olson et al.
2007/0117683 A1 5/2007 Ercanbrack et al.
2007/0254778 A1 11/2007 Ashby
2008/0051256 A1 2/2008 Ashby et al.
2008/0242520 A1 10/2008 Hubbard
2008/0300110 A1 12/2008 Smith et al.
2009/0105052 A1 4/2009 Dalebout et al.
2009/0137367 A1* 5/2009 Hendrickson ..... A63B 24/00 482/54
2010/0242246 A1 9/2010 Dalebout et al.
2012/0237911 A1 9/2012 Watterson
2012/0295774 A1 11/2012 Dalebout et al.
2013/0123083 A1 5/2013 Sip
2013/0165195 A1 6/2013 Watterson
2013/0172152 A1 7/2013 Watterson
2013/0172153 A1 7/2013 Watterson
2013/0178334 A1 7/2013 Brammer
2013/0178768 A1 7/2013 Dalebout
2013/0190136 A1 7/2013 Watterson
2013/0196298 A1 8/2013 Watterson
2013/0196821 A1 8/2013 Watterson et al.
2013/0196822 A1 8/2013 Watterson et al.
2013/0218585 A1 8/2013 Watterson
2013/0244836 A1 9/2013 Maughan
2013/0267383 A1 10/2013 Watterson
2013/0268101 A1 10/2013 Brammer
2013/0274067 A1 10/2013 Watterson et al.
2013/0281241 A1 10/2013 Watterson
2014/0024499 A1 1/2014 Watterson
2014/0073970 A1 3/2014 Ashby
2014/0121071 A1 5/2014 Strom et al.
2014/0135173 A1 5/2014 Watterson
2014/0274574 A1 9/2014 Shorten et al.
2014/0274579 A1 9/2014 Olson
2014/0287884 A1 9/2014 Buchanan
2014/0309085 A1 10/2014 Watterson et al.
2015/0182779 A1 7/2015 Dalebout
2015/0182781 A1 7/2015 Watterson
2015/0238817 A1 8/2015 Watterson
2015/0250418 A1 9/2015 Ashby
2015/0251055 A1 9/2015 Ashby
2015/0253210 A1 9/2015 Ashby et al.
2015/0253735 A1 9/2015 Watterson
2015/0253736 A1 9/2015 Watterson
2015/0258560 A1 9/2015 Ashby
2015/0352396 A1 12/2015 Dalebout
2016/0058335 A1 3/2016 Ashby
2016/0063615 A1 3/2016 Watterson
2016/0092909 A1 3/2016 Watterson
2016/0101311 A1 4/2016 Workman
2016/0107065 A1 4/2016 Brammer
2016/0121074 A1 5/2016 Ashby
2016/0148535 A1 5/2016 Ashby
2016/0148536 A1 5/2016 Ashby
2016/0158595 A1 6/2016 Dalebout
2016/0206922 A1 7/2016 Dalebout et al.
2016/0250519 A1 9/2016 Watterson
2016/0253918 A1 9/2016 Watterson
2016/0346595 A1 12/2016 Dalebout et al.
2017/0036053 A1 2/2017 Smith et al.
2017/0056711 A1 3/2017 Dalebout et al.
2017/0056715 A1 3/2017 Dalebout et al.
2017/0056726 A1 3/2017 Dalebout et al.
2017/0124912 A1 5/2017 Ashby et al.
2017/0193578 A1 7/2017 Watterson
2017/0266481 A1 9/2017 Dalebout
2017/0266483 A1 9/2017 Dalebout et al.
2017/0266489 A1 9/2017 Douglass et al.
2017/0270820 A1 9/2017 Ashby
2018/0001135 A1 1/2018 Powell
2018/0036585 A1 2/2018 Powell
2018/0085630 A1 3/2018 Capell et al.
2018/0089396 A1 3/2018 Capell et al.
2018/0099116 A1 4/2018 Ashby
2018/0099179 A1 4/2018 Chatterton et al.
2018/0099180 A1 4/2018 Wilkinson
2018/0111034 A1 4/2018 Watterson
2018/0117383 A1 5/2018 Workman
2018/0117385 A1 5/2018 Watterson et al.
2018/0117393 A1 5/2018 Ercanbrack
2018/0154205 A1 6/2018 Watterson
2018/0154207 A1 6/2018 Hochstrasser
2018/0154209 A1 6/2018 Watterson
2018/0200566 A1 7/2018 Weston
2019/0058370 A1 2/2019 Tinney
2019/0080624 A1 3/2019 Watterson
2019/0151698 A1 5/2019 Olson
2019/0168072 A1 6/2019 Brammer
2019/0178313 A1 6/2019 Wrobel
2019/0192898 A1 6/2019 Dalebout
2019/0192952 A1 6/2019 Powell
2019/0209893 A1 7/2019 Watterson
2019/0223612 A1 7/2019 Watterson
2019/0269958 A1 9/2019 Dalebout et al.
2019/0269971 A1 9/2019 Capell et al.
2019/0282852 A1 9/2019 Dalebout
2019/0328079 A1 10/2019 Ashby et al.
2019/0329091 A1 10/2019 Powell et al.

(56) References Cited

U.S. PATENT DOCUMENTS

| | | | |
|---|---|---|---|
| 2019/0376585 | A1 | 12/2019 | Buchanan |
| 2020/0009417 | A1 | 1/2020 | Dalebout |

FOREIGN PATENT DOCUMENTS

| | | |
|---|---|---|
| TW | 177052 | 1/1992 |
| TW | M253381 | 12/2004 |
| TW | M254239 | 1/2005 |
| TW | M333198 | 6/2008 |
| TW | I304351 | 12/2008 |
| TW | M517957 | 2/2016 |
| WO | 198907473 | 8/1989 |

OTHER PUBLICATIONS

U.S. Appl. No. 15/973,176, filed May 7, 2018, Melanie Douglass.
U.S. Appl. No. 16/506,085, filed Jul. 9, 2019, ICON Health & Fitness, Inc.
U.S. Appl. No. 29/021,127, filed Sep. 16, 2019, ICON Health & Fitness, Inc.
U.S. Appl. No. 62/796,952, filed Jan. 25, 2019, ICON Health & Fitness, Inc.
U.S. Appl. No. 62/804,146, filed Feb. 11, 2019, ICON Health & Fitness, Inc.
U.S. Appl. No. 62/804,685, filed Feb. 12, 2019, ICON Health & Fitness, Inc.
U.S. Appl. No. 62/852,118, filed May 22, 2019, David Hays.
U.S. Appl. No. 62/866,576, filed Jun. 25, 2019, ICON Health & Fitness, Inc.
U.S. Appl. No. 62/887,391, filed Aug. 15, 2019, ICON Health & Fitness, Inc.
U.S. Appl. No. 62/887,398, filed Aug. 15, 2019, ICON Health & Fitness, Inc.
U.S. Appl. No. 62/897,113, filed Sep. 9, 2019, ICON Health & Fitness, Inc.
Taiwan Search Report and Office Action issued in application No. 106136812 dated Jun. 25, 2018 with English translation.
International Search Report and Written Opinion issued in PCT/US2017/064529 dated Mar. 20, 2018.
Taiwan Search Report and Office Action issued in application No. 106122194 dated Jan. 19, 2018 with English translation.
Darken et al., The Omni-Directional Treadmill: A Locomotion Device for Virtual Worlds, Calhoun: The NPS Institutional Archive DSPACE Repository, 1997.

* cited by examiner

COOLING METHODS FOR EXERCISE EQUIPMENT

CROSS-REFERENCE TO RELATED APPLICATIONS

This application is a continuation of U.S. patent application Ser. No. 15/785,302, filed Oct. 17, 2017, which is a continuation-in-part of U.S. patent application Ser. No. 15/639,935, filed on Jun. 30, 2017, which claims priority of U.S. Provisional Patent Application No. 62/357,815, which are hereby incorporated by reference in their entireties.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved during aerobic exercise. Popular forms of aerobic exercise include running, jogging, swimming, and cycling, among others activities. In contrast, anaerobic exercise typically involves high intensity exercises over a short duration of time. Popular forms of anaerobic exercise include strength training and short distance running.

Many people choose to perform aerobic exercises indoors, such as in a gym or their home. Often, a user will use an aerobic exercise machine to perform an aerobic workout indoors. One type of aerobic exercise machine is a treadmill, which is a machine that has a running deck attached to a support frame. The running deck can support the weight of a person using the machine. The running deck incorporates a conveyor belt that is driven by a motor. A user can run or walk in place on the conveyor belt by running or walking at the conveyor belt's speed. The speed and other operations of the treadmill, including incline, are generally controlled through a control module that is also attached to the support frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include elliptical trainers, rowing machines, stepper machines, and stationary bikes to name a few.

One type of treadmill is disclosed in World Intellectual Property Organization Publication No. WO/1989/07473 issued to Steven T. Sherrard, et al. In this reference, an exercise treadmill includes transverse modular components that are fixably, yet slidably supported through T-slots in extruded side rails having inwardly opening T-slots. Landings integral with the side rails cover the edges of the tread belt. The bed is carried on bed rails supported on the side rails by bolts extending through the T-slots into bed slides. Transverse bed supports capped by resilient shock mounts support the center of the bed. Idler and drive rollers at opposite ends of the bed are slidably supported through the T-slots of the side rails on bearing slides. The rear idler roller is adjustably positioned by bolts engaging end caps at the rear ends of the side rails. A motor moves the tread belt over the bed and rollers. An inertial flywheel, fan, and encoder wheel are mounted on the motor axle. A linear lift mechanism within the stanchion raises and lowers the treadmill. This reference also indicates that the inertial flywheel is significantly heavier than those found in other exercise treadmills to reduce the peak loads placed on the treadmill's motor. A fan recessed within the outer surface of the flywheel draws air between the spokes of the flywheel and over the air inlet grill of the motor.

BRIEF SUMMARY

In one embodiment, an exercise machine includes a deck, a motor housing incorporated into the deck, a console positioned at an elevation above the motor housing, a fan associated with at least one of a lift motor and a drive motor in the motor housing, an airflow pathway extending from a location adjacent the fan through a first outlet vent located in the console to a location above the motor housing, and a cooling mechanism that cools the lift motor when the cooling mechanism is activated and configured to selectively alter airflow flowing through the airflow pathway.

The cooling mechanism may include a clutch coupled with the fan. The clutch may include an electromagnetic clutch.

The clutch may be in a normally engaged state.

The cooling mechanism may include a fan assembly.

The cooling mechanism may include an air diverter.

The diverter may be displaceable between at least two different positions, including a first position wherein substantially all airflow is directed through the first outlet vent, and a second position wherein all airflow is directed through a second vent to a location away from the location above the motor housing.

The diverter may be displaceable to at least a third position wherein a first portion of the airflow is directed through the first outlet vent and a second portion of the airflow is directed through the second outlet vent.

The diverter may be placed in the first position upon starting operation of the exercise machine.

The exercise machine may include at least one post member extending from a location adjacent the deck up to the console, and wherein the airflow pathway extends through an interior portion of the at least one post member.

An inlet vent may be located in the at least one post member and be in fluid communication with the airflow pathway.

The exercise machine may include at least one auxiliary fan disposed within the airflow pathway.

The at least one auxiliary fan may be configured to begin operation upon starting operation of the exercise machine.

The exercise machine may include a flywheel where the fan assembly is attached to the flywheel and the fan assembly generates an airflow that directs air across the lift motor.

Generating the airflow may include pushing air towards the lift motor.

Generating the airflow may include drawing air towards the fan assembly across the lift motor.

The exercise machine may include a first pulley incorporated into the deck, a tread belt incorporated into the deck and in engagement with the first pulley, a drive motor in mechanical communication with the first pulley, and the flywheel being rotationally fixed with respect to the drive motor. When the drive motor causes the tread belt to move in a rotational direction and causes the flywheel to spin, the fan assembly directs air across the lift motor.

The exercise machine may include a second pulley incorporated into the deck at an opposite end of the deck than the first pulley, and the tread belt surrounds the first pulley and the second pulley.

The drive motor, flywheel, and fan assembly may be coaxial, and the fan assembly may be located adjacent to the lift motor.

The exercise machine may include a second fan assembly connected to a second side of the flywheel, where the second fan assembly generates a second airflow when the flywheel rotates, the second airflow being configured to pass over the drive motor.

The exercise machine may include a dump resistor connected to the drive motor where the dump resistor is positioned within the airflow generated with the fan assembly.

The cooling mechanism may include a ring member, an annulus defined in the ring member, and at least one fan blade formed on the ring member.

When the ring member is rotating, a pressure drop may be generated within the annulus.

The exercise machine may include an annular lip formed on the circumference of the ring member and adjacent to the fan blade.

The exercise machine may include a housing and at least one vent located in a bottom side of the housing where the lift motor and the cooling mechanism are located within the housing.

In one embodiment, a fan assembly includes a ring member, a face of the ring member, an annulus defined in the ring member, and at least one fan blade formed on the face of the ring member.

When the ring member is rotating, a pressure drop may be generated within the annulus.

The fan assembly may include an annular lip formed on the circumference of the ring member and adjacent to the fan blade.

The fan assembly may include the ring member that is attached to a flywheel, where a pressure drop pulls intake air towards the annulus and where the flywheel and the annular lip collectively reverse the flow of the intake air away from the annulus at an angle greater than ten degrees with respect to a rotational axis of the ring member.

The fan assembly may be incorporated into a treadmill and directs an airflow across a lift motor.

In some embodiments, a method for cooling a motor on a treadmill includes rotating a flywheel with a drive motor.

The method may include rotating a ring member coupled to a flywheel.

A pressure drop may be generated in an annulus of the ring member between the drive motor and the lift motor.

Intake air may be drawn in a first direction across the lift motor toward the pressure drop.

Drawing the intake air in the first direction may include cooling the lift motor.

Generating the pressure drop may include rotating at least one fan blade of a fan assembly in the ring member.

The fan assembly may be a first fan assembly and the intake air may be a first flow of air, the method further comprising rotating a second fan assembly on the flywheel opposite the first fan assembly and drawing a second flow of air toward the second fan assembly across the drive motor.

The method may further comprise redirecting the intake air in a second direction at a distal circumference of the ring member.

The intake air may be redirected by a circumferential lip on the distal circumference of the ring member.

Another method for cooling a treadmill may include changing a height of a deck with a lift motor, lift motor generating heat.

The method may further include cooling the lift motor by rotating a fan assembly on a flywheel coaxial with a drive motor and drawing air toward the fan assembly across the lift motor.

The air may be diverted to an exhaust vent.

In some embodiments, diverting the air may include exhausting the air over a deck of the treadmill.

In other embodiments, diverting the air may include directing the air through an air channel located in a post.

In still other embodiments, diverting the air may include changing a position of an air diverter to change a flow path of the air.

In yet other embodiments, diverting the air may include pulling the air with an auxiliary fan in a flow path of the air.

In further embodiments, diverting the air may include flowing air across electronics in a console.

In still further embodiments, diverting the air may include diverting the air away from a user operating the treadmill.

A method for operating a cooling mechanism may include rotating a fan assembly with a drive motor.

Air may be drawn in a first direction across the lift motor.

The air may be directed toward a distal edge of the fan assembly.

The air may be rerouted from the first direction to a second direction at a circumferential lip on a distal edge of the fan assembly.

Drawing the air in the first direction may include drawing the air from the lift motor toward the fan assembly and the drive motor.

The second direction may be between 120° and 175° of the first direction.

The method may further include disengaging the fan assembly with a clutch assembly.

Disengaging the fan assembly may include disengaging the fan assembly based on an input from a user.

Rerouting the air from the first direction to the second direction may include reducing noise generated by a flow of the air by about 50%.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. Often, the width of an object is transverse the object's length. Additionally, for purposes of this disclosure, the term "post" generally refers to an upright structural member.

Figure 1:
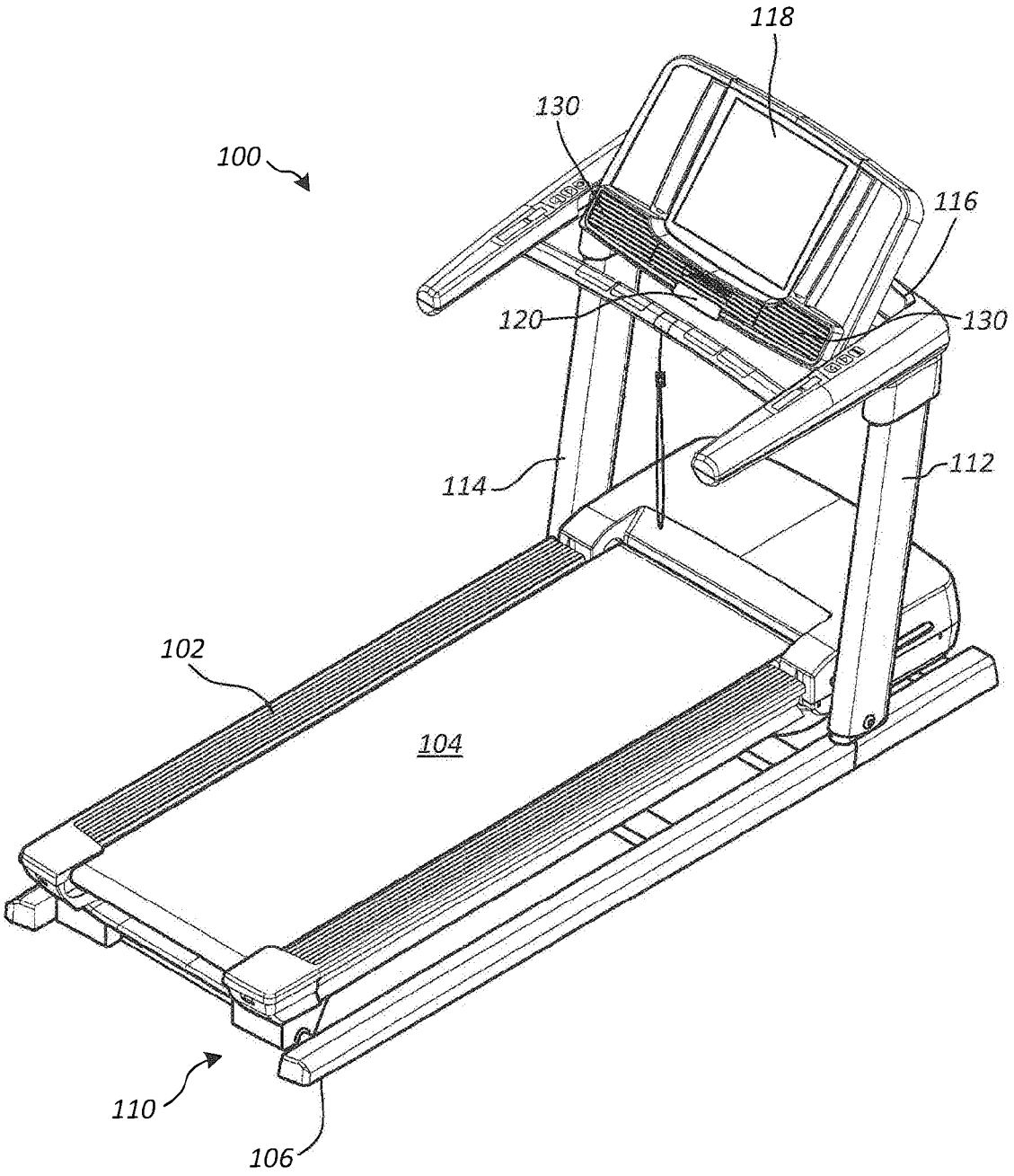
FIG. 1 depicts an example of an exercise machine in accordance with aspects of the present disclosure.

FIG. 1 depicts an example of a treadmill 100 having a deck 102 with a first pulley disposed in a front portion of the deck 102 and a second pulley incorporated into a rear portion of the deck 102. A tread belt 104 surrounds the first pulley and the second pulley. A drive motor is in mechanical communication with either the first pulley or the second pulley.

The rear portion of the deck 102 is attached to a base member 106 of the treadmill's frame. A pivot connection 110 between the rear portion of the deck 102 and the base member 106 allows the front portion of the deck 102 to incline upwards or decline downwards. When the deck 102 inclines or declines, the base member 106 remains stationary.

A first side post 112 is attached to a first side of the base member 106, and a second side post 114 is attached to a second side of the base member 106. In the example depicted in FIG. 1, the first side post 112 and the second side post 114 also remain stationary as the deck 102 inclines and/or declines. The first side post 112 and the second side post 114 collectively support a console 116. The console 116 includes a display 118 and an input mechanism 120 for controlling the deck's incline angle. A vent or other outlet 130 may also be formed in the console 116 and configured to exhaust airflow to a location above the treadmill deck 102 and onto a user during operation of the treadmill 100.

Figure 2:
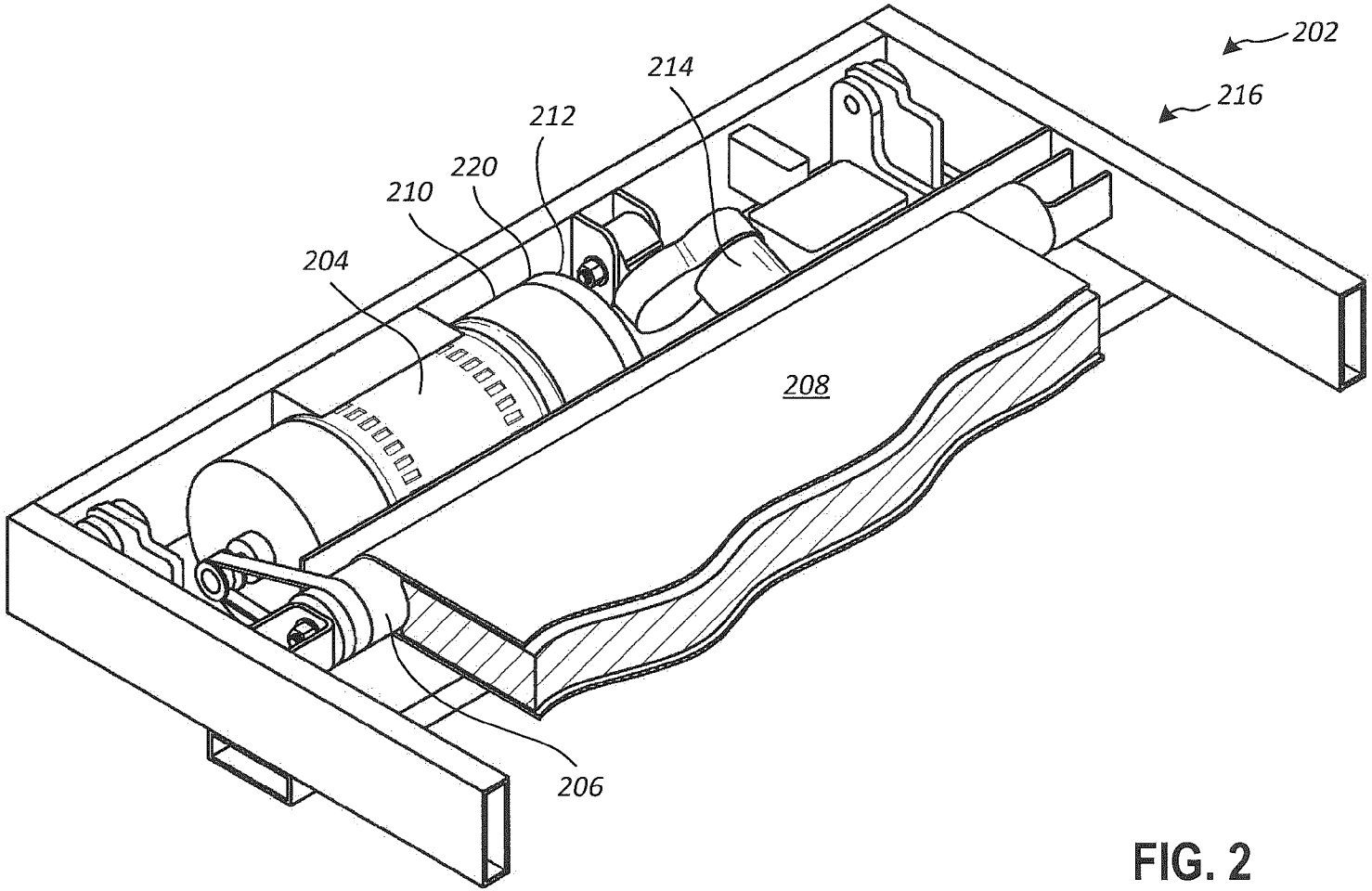
FIG. 2 depicts an example cut-away view of an exercise machine in accordance with aspects of the present disclosure.

FIG. 2 illustrates a cut-away view of an example of a treadmill 202 with a cover removed for illustrative purposes. Inside the cover, a drive motor 204 is disposed adjacent to a pulley 206 that moves the tread belt 208 in a rotational direction. Attached to and coaxial with the drive motor 204 is a flywheel 210. The flywheel 210 rotates with the drive motor 204.

A fan assembly 212 is connected to the flywheel 210 on the side that is away from the drive motor 204. The fan assembly 212 is also coaxial with the drive motor 204. A lift motor 214 is adjacent to the fan assembly 212. The lift motor 214 is oriented so that it is connected to the deck 216 and also to the base frame (e.g., 106 in FIG. 1) of the treadmill. When activated, the lift motor 214 causes a rod to extend downward, which pushes against the front portion of the deck and the base frame causing the front portion of the deck to raise. In other situations, when the lift motor 214 is activated, the rod is retracted, which causes the front portion of the deck to lower. In these cases, the lift motor 214 may be transversely oriented with respect to the fan assembly 212.

In some cases, the lift motor 214 is located within inches of the fan assembly 212. In some situations, the lift motor 214 is located less than an inch away from the fan assembly 212. When the drive motor 204 is active, the flywheel 210 and the fan assembly 212 rotate together. The fan assembly 212 causes air to flow around the lift motor 214, which can lower the lift motor's temperature, including due to convection type heat transfer. The other components within the housing may also experience a temperature drop due to the operation of the fan assembly 212.

In some cases, a clutch mechanism 220 mechanism is placed between the flywheel 210 and the fan assembly 212. In some cases, the clutch mechanism 220 is configured to be normally engaged (meaning the fan assembly is coupled with, and rotates with, the flywheel) and can be selectively disengaged. In one example, an input mechanism (e.g., 120 in FIG. 1) may be actuated by a user to selectively disengage and/or reengage the fan assembly 212 with the flywheel 210.

Figure 3:
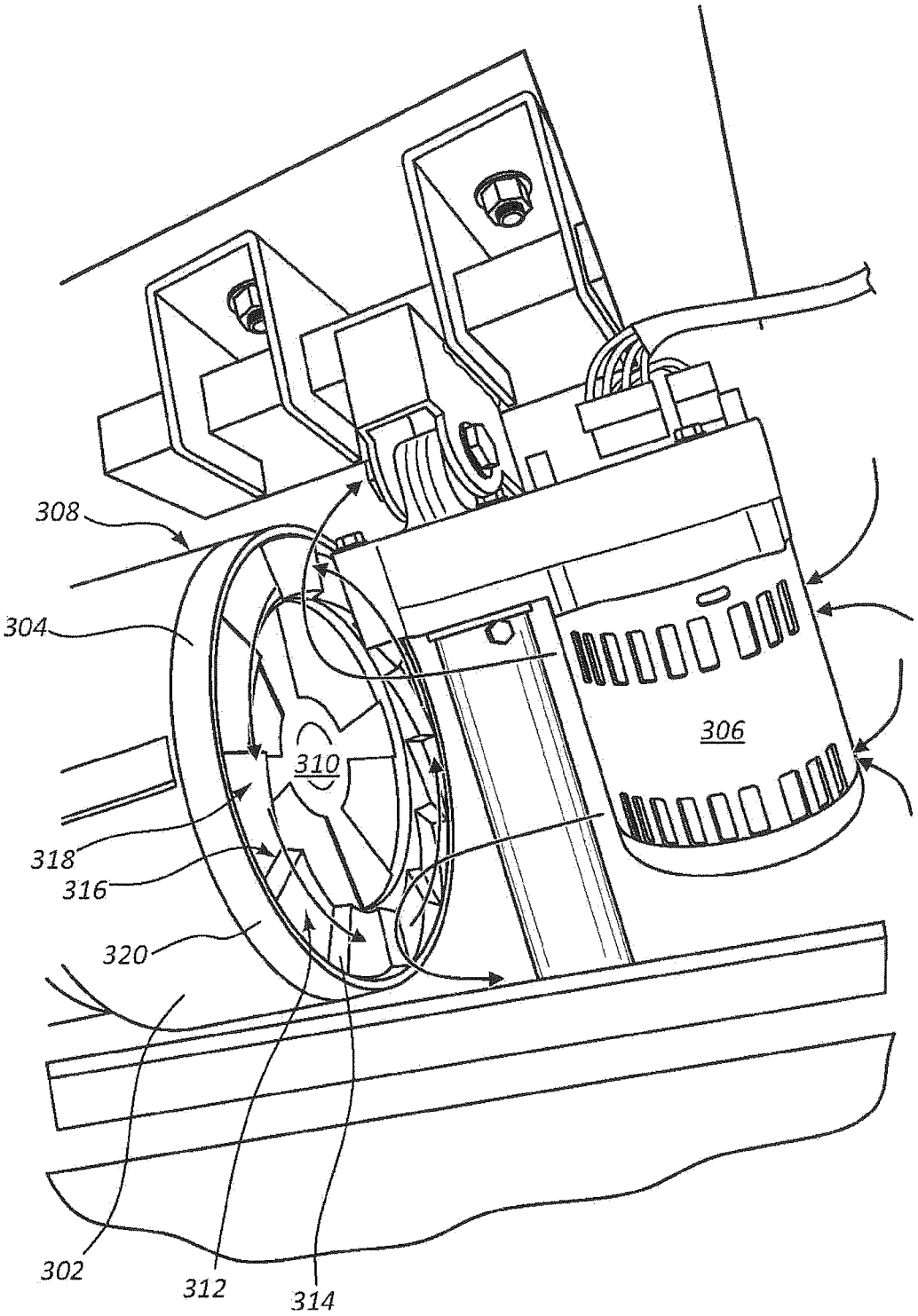
FIG. 3 depicts an example of a cooling mechanism in accordance with aspects of the present disclosure.

FIG. 3 illustrates an example of a treadmill 300 with a cover removed for illustrative purposes. The treadmill 300 includes a flywheel 302 and a fan assembly 304 attached to the flywheel 302. A lift motor 306 is located adjacent to the fan assembly 304.

In this example, the fan assembly 304 includes a ring member 308 that defines a central annulus 310. Distally located with respect to the central annulus 310, a plurality of fan blades 312 or ramps are formed in the ring member's face 314. While any appropriate type of fan blade geometry may be used, the fan blade geometry in this example includes a leading side 316 that forms an edge face that is transversely oriented with a base of the fan assembly 304. A trailing side 318 of the fan blade 312 tapers towards a base of the ring member 308 and towards an adjacent fan blade. A circumferential lip 320 is located on the circumference of the ring member 308. In this example, the circumferential lip has a height that is approximately the height of the leading side 316 of the fan blades 312.

Figure 4A:
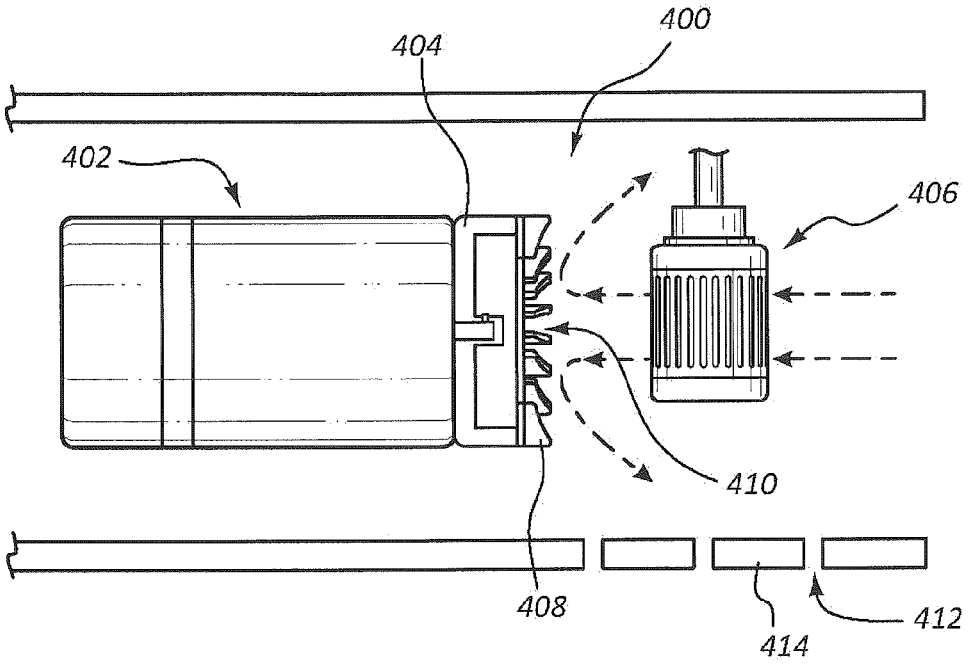
FIG. 4A depicts an example of a cooling mechanism in accordance with aspects of the present disclosure.

FIG. 4A illustrates an example of the cooling mechanism 400. In this example, the cooling mechanism 400 includes the drive motor 402, the flywheel 404, and the fan assembly 408. The lift motor 406 is located adjacent to the drive motor 402.

As the drive motor 402 rotates, the flywheel 404 and fan assembly 408 also rotate. As the fan assembly 408 rotates, a pressure drop is generated in the annulus 410 of the ring member. This pressure drop draws air towards the annulus of the ring member, creating an airflow across the lift motor 406. The fan blades of the fan assembly 408 push air outward across the leading sides of the fan blades towards the circumferential lip of the fan blade. The circumferential lip pushes the airflow forward so that the intake air reverses its direction. In some examples, the airflow is rerouted between 120 degrees to 175 degrees relative to the intake air's initial travel direction.

With the movement of the air generated by the fan assembly, a pressure drop may be generated behind the fan assembly and adjacent the flywheel 404. In this example, the air from behind the fan assembly 408 may be drawn across the drive motor 402 and into the airflow, thereby increasing the air circulation in the entire housing, while also cooling the drive motor. Vent openings 412 may be formed in the bottom portion 414 of the housing to increase an air exchange between the inside and outside of the motor housing.

Figure 4B:
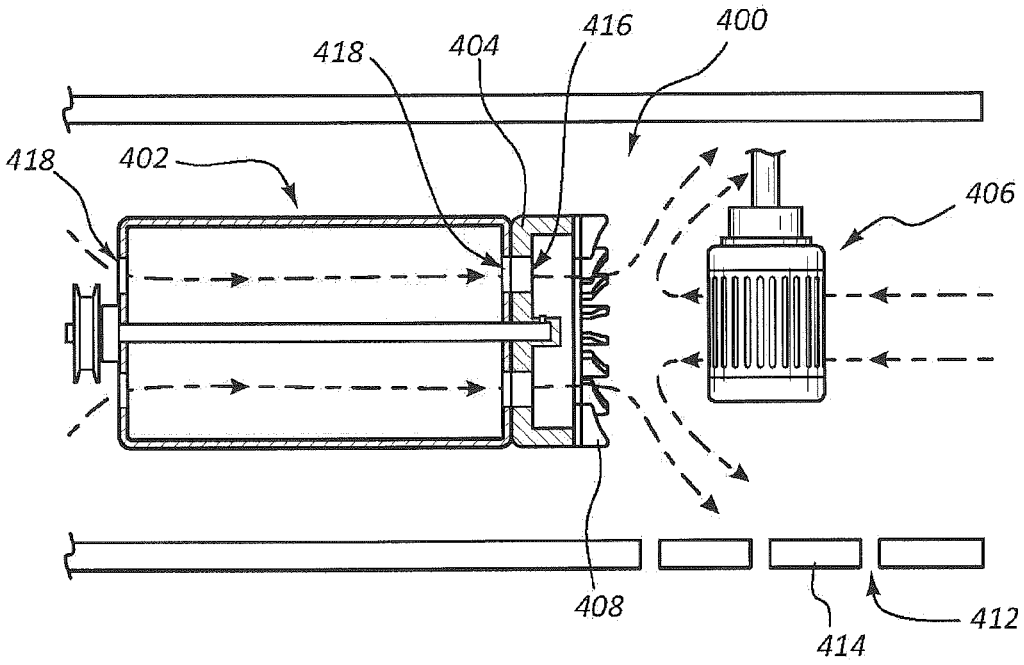
FIG. 4B illustrates a cross-sectional view of an example cooling mechanism in accordance with aspects of the present disclosure.

FIG. 4B illustrates a cross-sectional view of an example variation to the cooling mechanism 400 of FIG. 4A. As illustrated in FIG. 4B, any number of flywheel orifices 416 may be defined by the center portion of the flywheel 404. Similarly, a plurality of motor housing orifices 418 may be defined by the outer housing of the drive motor 402. As illustrated, the inclusion of flywheel orifices 416 and motor housing orifices 418 may create a ventilation passageway that allows for the passage of air through the body of the drive motor 402, through the flywheel orifices 416, where it is then pushed outward across the leading sides of the fan blades towards the circumferential lip of the fan blade, as illustrated in FIG. 4A. This passage of air through the drive motor 402 can cool the drive motor and extend its useful life.

Figure 5:
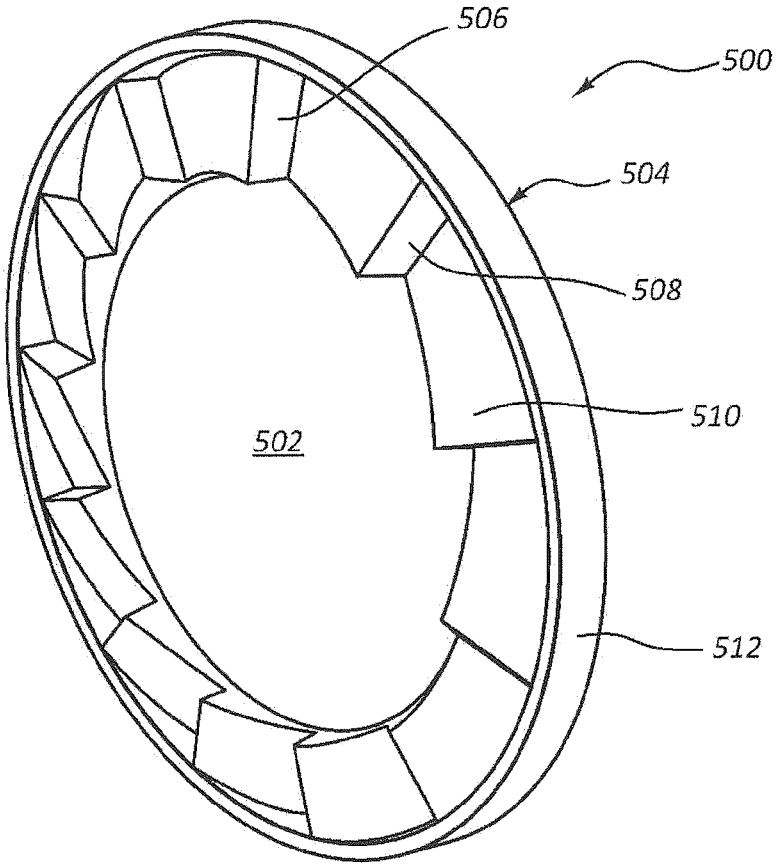
FIG. 5 depicts an example of a cooling mechanism in accordance with aspects of the present disclosure.

FIG. 5 illustrates an example of a cooling mechanism 500. In this example, the cooling mechanism includes an annulus 502 centrally located within the ring member 504. A plurality of fan blades 506 or ramps are distally located on the annulus 502. As shown by the rotation al arrow of FIG. 5, the illustrated cooling mechanism is configured to rotate in a counter-clockwise direction. For ease of explanation, each cooling mechanism will be described and illustrated herein as rotating in a counter-clockwise direction during operation, as viewed from the front of the cooling mechanism. It is understood that the speed, rotation, and/or orientation of each cooling mechanism may be modified and/or reversed to change the resulting airflow properties.

Continuing with FIG. 5, each of the fan blades 506 includes a leading side 508 and a trailing side 510. The leading side 508 includes an edge face that extends from a base of the ring member 504. The trailing side 510 of the fan blade progressively tapers towards an adjacent fan blade and towards the base of the ring member 504. A circumferential lip 512 is disposed distally to the fan blades 506 and includes a height that is substantially the height of the blades' edge face.

Figure 6:
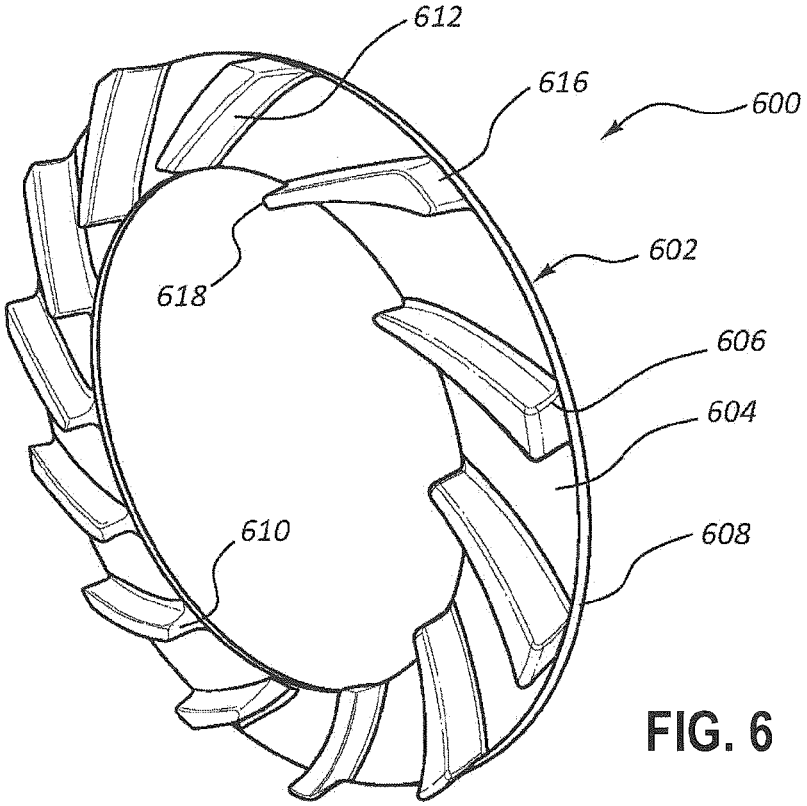
FIG. 6 depicts an example of a cooling mechanism in accordance with aspects of the present disclosure.

FIG. 6 illustrates an example of a cooling mechanism 600. In this example, the cooling mechanism 600 includes a ring member 602 with a fan face 604. A plurality of fan blades 606 are formed in the fan face 604. The fan blades 606 span the fan face from an outer ring diameter 608 to an inner ring diameter 610. Each fan blade 606 includes a leading side 612, a distal side 614, a trailing side 616, and a proximal side 618. In this example, the distal side 614 of the fan blades is forward of the proximal side 618. Additionally, the cross sectional thickness of the fan blade at the distal side 614 is greater than the fan blade's cross sectional thickness at the proximal side 618. The leading side 612 of the fan blade 606 has a slightly concave surface and the trailing side 616 has a slightly convex surface. In this example, the ring member 602 does not include a circumferential lip.

Figure 7:
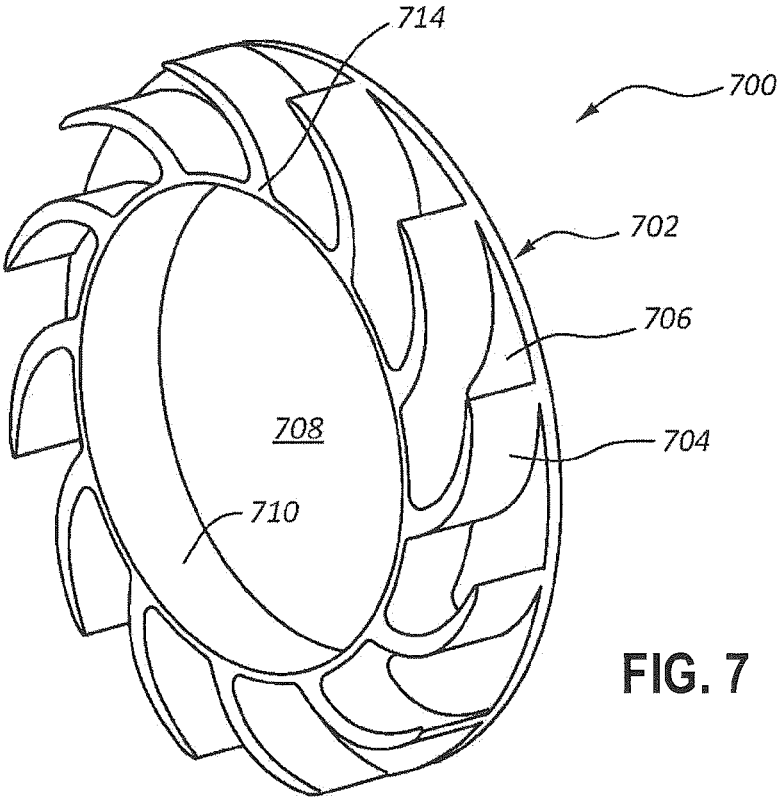
FIG. 7 depicts an example of a cooling mechanism in accordance with aspects of the present disclosure.

FIG. 7 illustrates an example of a cooling mechanism 700. In this example, the ring member 702 includes a plurality of fan blades 704 spaced along the ring's fan face 706. The ring member 702 includes an inner diameter defined by an annulus 708 in the ring member 702. An inner circumferential lip 710 is located on the inner diameter 712 which is integrally formed with the proximal sides 714 of the fan blades 704.

Figure 8:
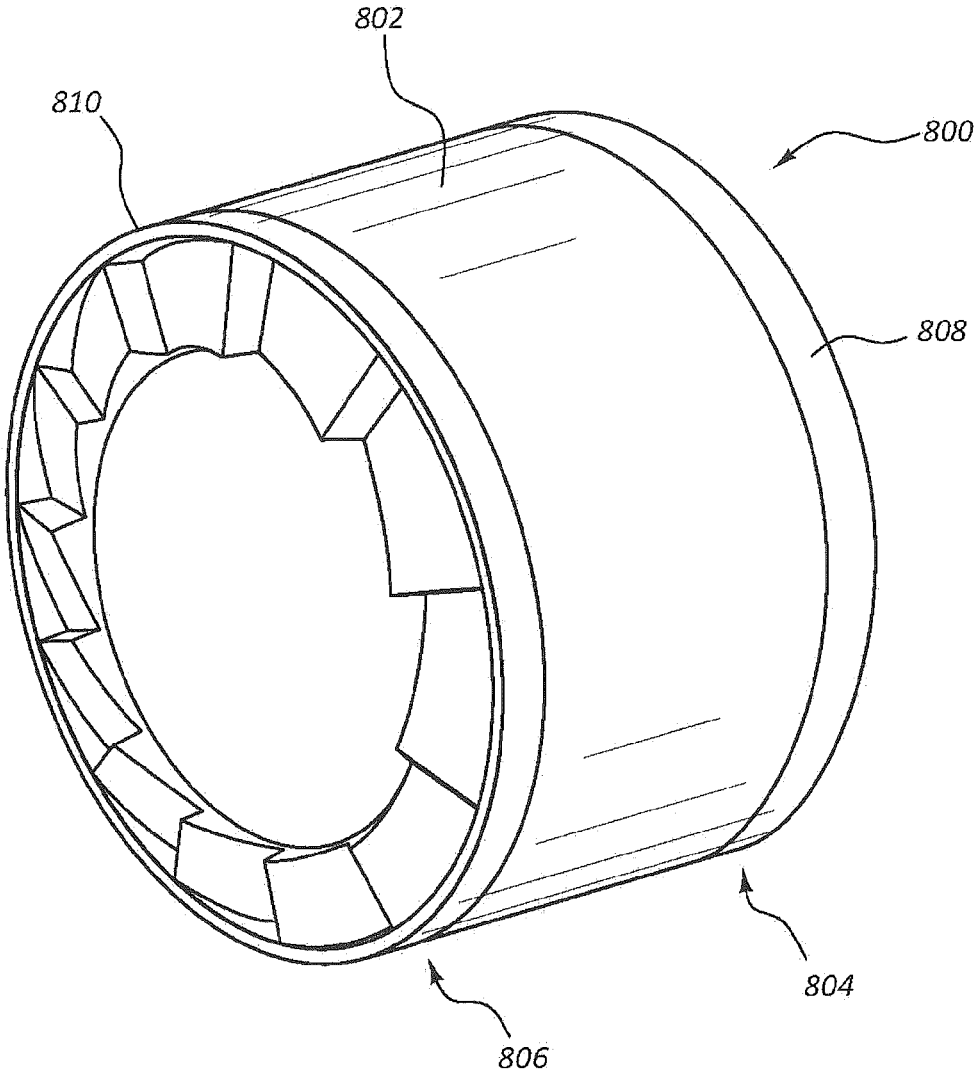
FIG. 8 depicts an example of a cooling mechanism in accordance with aspects of the present disclosure.

FIG. 8 illustrates an example of a cooling mechanism 800. In this example, the cooling mechanism 800 includes a flywheel 802 with a first side 804 and a second side 806 opposite the first side 804. A first fan assembly 808 may be attached to the first side 804, and a second fan assembly 810 may be attached to the second side 806. As the flywheel 802 rotates, the first fan assembly 808 and the second fan assembly 810 may rotate simultaneously causing separate airflows to be generated. In some cases, the lift motor may be primarily cooled by an airflow generated by the first fan assembly 808 and the drive motor may be primarily cooled by an airflow generated by the second fan assembly 810.

Figure 9:
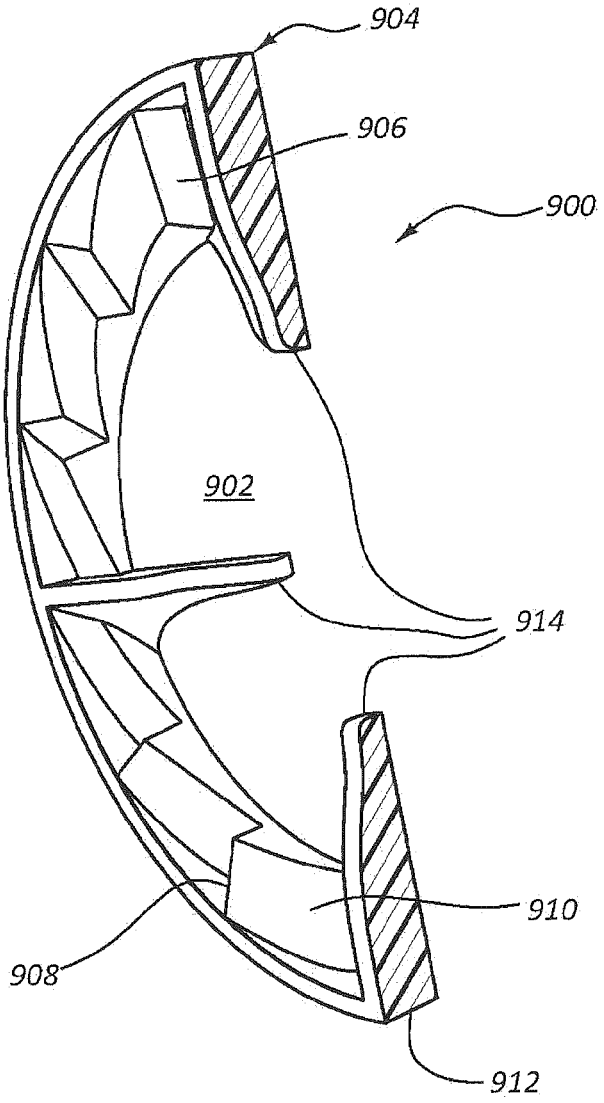
FIG. 9 illustrates a cross-sectional example of a cooling mechanism in accordance with aspects of the present disclosure.

FIG. 9 shows a cross-sectional view of an example of a cooling mechanism 900. Similar to FIG. 5 above, the cooling mechanism includes an annulus 902 centrally located within the ring member 904. A plurality of fan blades 906 or ramps are distally located on the annulus 902. each of the fan blades 906 includes a leading side 908 and a trailing side 910. A circumferential lip 912 is disposed distally to the fan blades 906 and is illustrated as having a height that is substantially the height of the blades' edge face. Additionally, one or more extended fan blades 914 may extend into the annulus 902 to further aid in the movement of air in and around the cooling mechanism 900. The extended fan blades 914 can assume the same geometry as the fan blades 906, or assume different geometries to selectively modify the airflow within the annulus 902.

Figure 10:
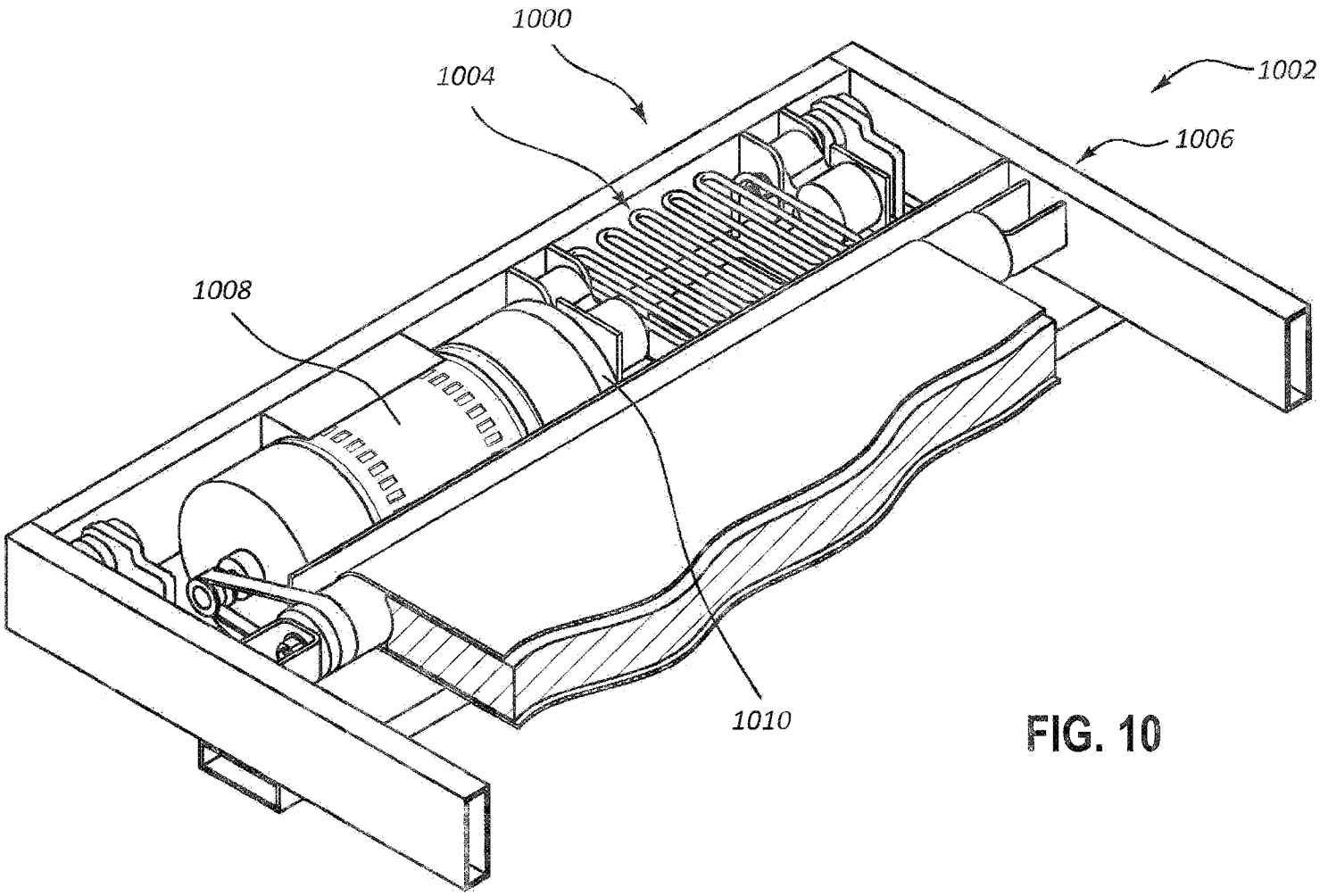
FIG. 10 depicts an example of a cooling mechanism in accordance with aspects of the present disclosure.

FIG. 10 illustrates an example of a cooling mechanism 1000 in a treadmill 1002. In this example, a dump resistor 1004 is located within the housing 1006. For ease of explanation, the lift motor 214 is not shown in FIG. 10. The dump resistor 1004 may be used to dissipate unneeded electricity in the system. In some cases, the drive motor 1008 may be the source of unneeded electricity. For example, in some cases the load on the motor is progressively reduced as the incline on the deck increases because the user's body weight contributes to moving the tread belt. At some incline angles, the user's body weight may generate all the force necessary to move the tread belt, so that there is no load on the drive motor. At even steeper incline angles, the user's body weight moves the tread belt, which correspondingly moves the pulley and therefore the drive motor 908 to the point where the drive motor 1008 generates electricity. This generated electricity may be directed to the dump resistor 1004, which converts the unneeded electricity into heat. The dissipated heat increases the temperature in the housing. The fan assembly 1010 may be used to cool the interior of the housing by drawing air across the dump resistor 1004. As illustrated, the dump resistor may be in the form of a coiled heating element.

Figure 11:
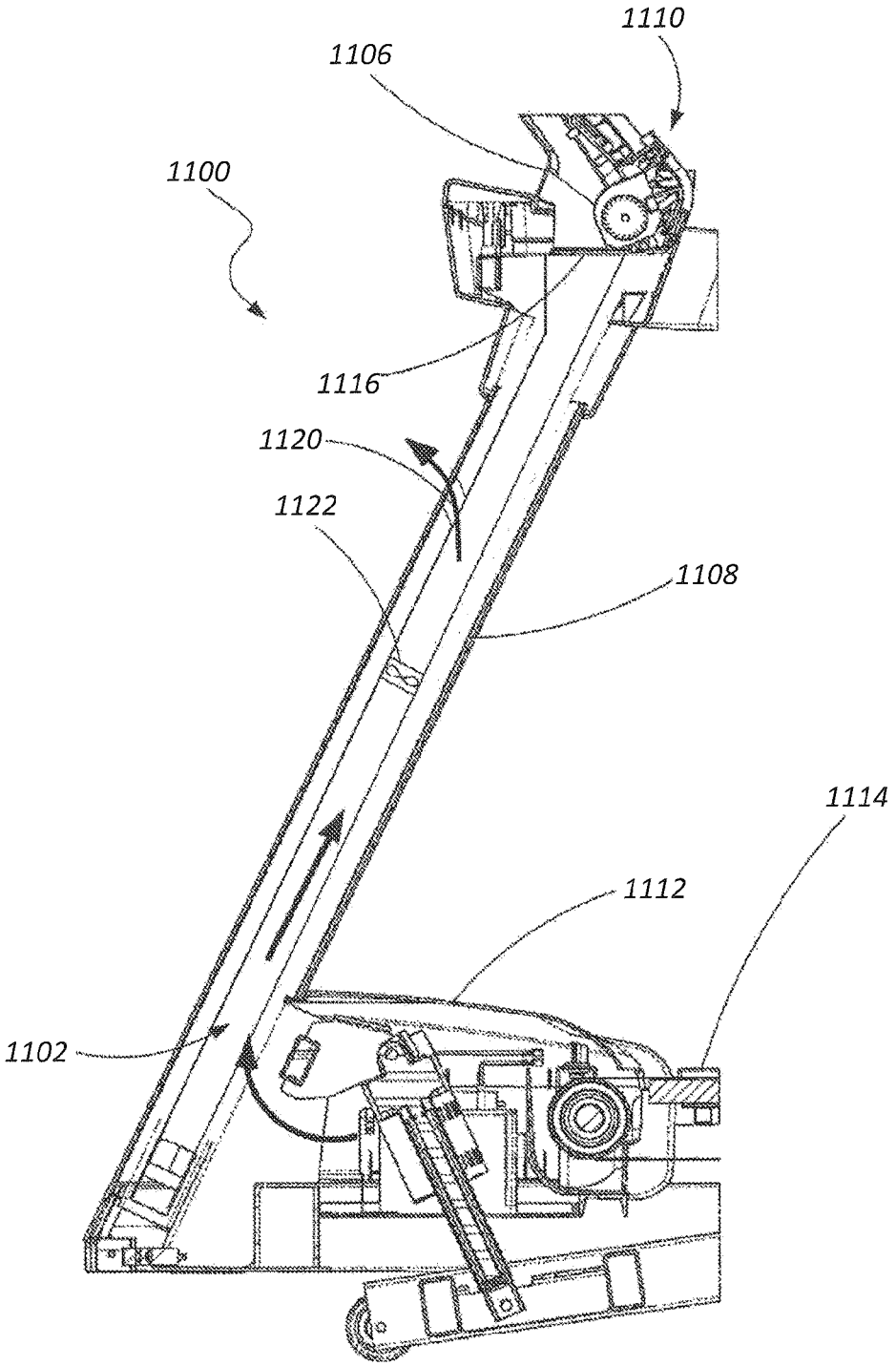
FIGS. 11-13 depict an example of an exercise machine incorporating a cooling system in accordance with aspects of the present disclosure.
Figure 12:
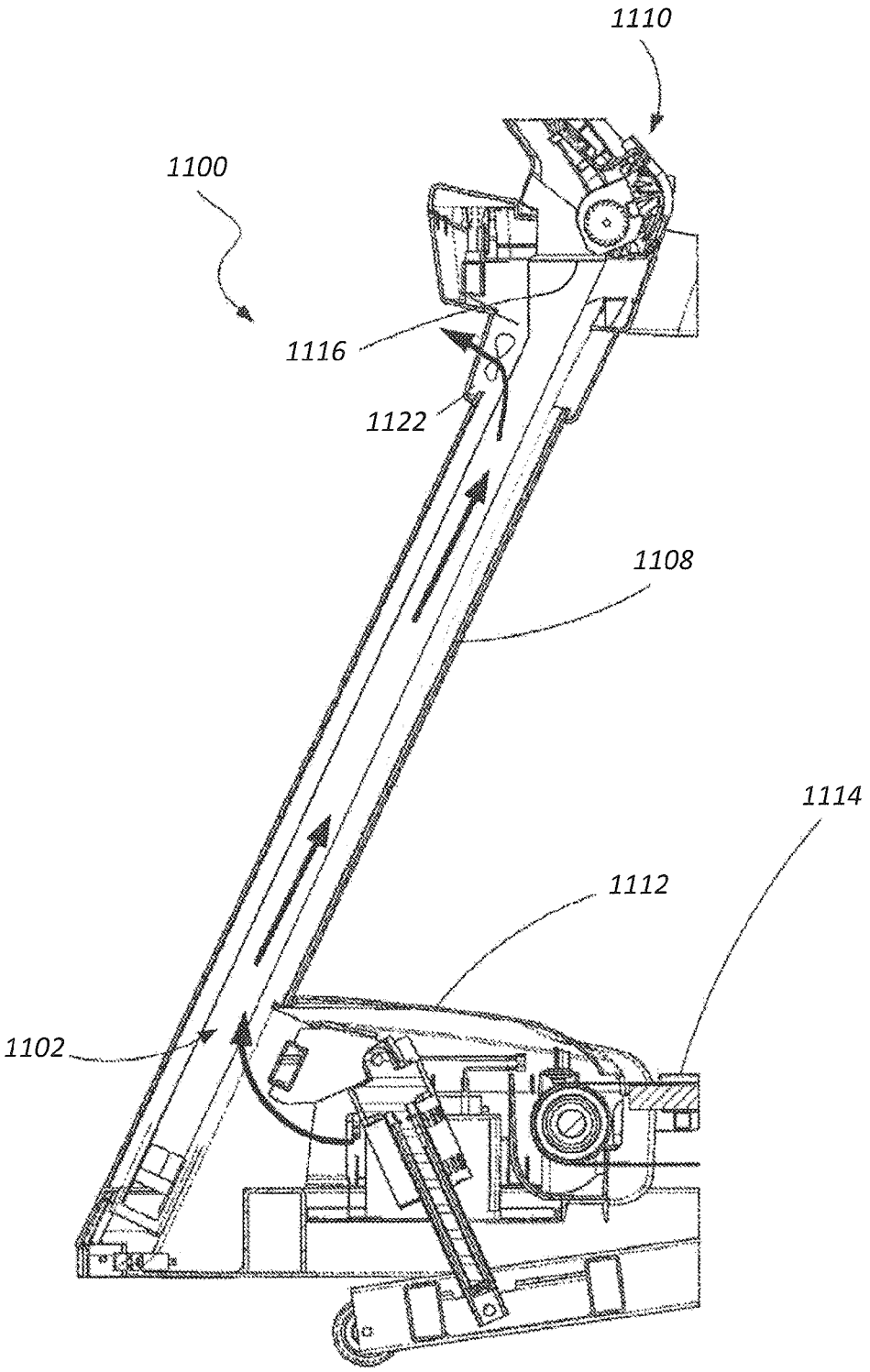
Figure 13:
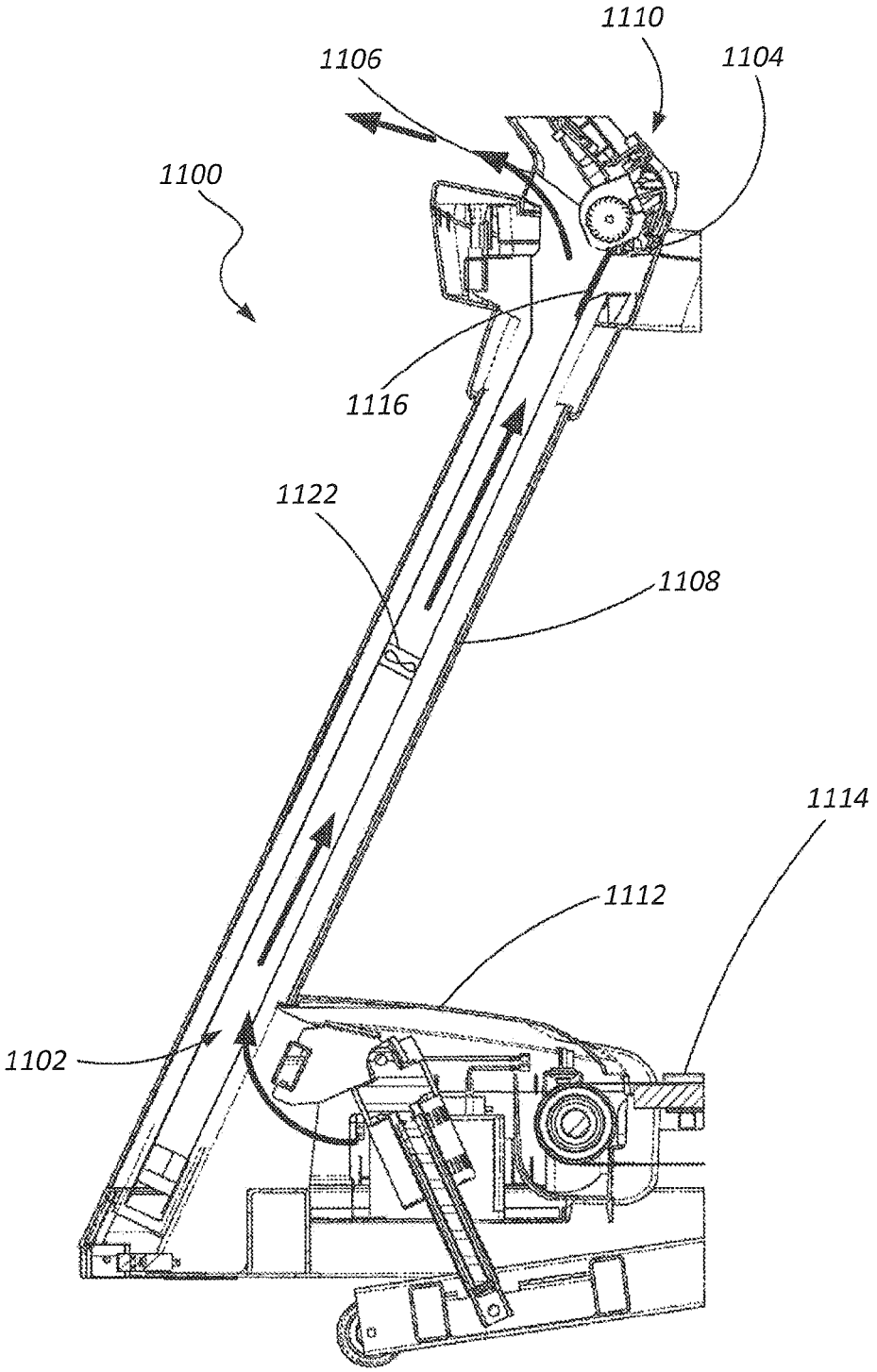

FIGS. 11-13 illustrate a treadmill 1100 that includes an airflow channel 1102 directing air from a fan (e.g., fan assembly 212 of FIG. 2) to one or more specified exhaust ports or vents 1106, 1120. In one example, an air channel 1102 is formed within one or both posts 1108 of the treadmill 1100 up into an internal area associated with the console 1110. Thus, airflow that is generated by a lift-motor (or other) fan assembly located within the shroud or cover 1112 (e.g., the cover associated with the drive and lift mechanisms) is directed to the console 1110 and exits through one or more of the exhaust vents 1106, 1120. While one exhaust vent 1120 is shown on the post 1108 of the treadmill 1100, any number of exhaust vents 1120 may be formed in the post to exhaust the airflow originating in the shroud or cover 1112.

As seen in FIG. 11, air generated by a fan within the cover 1112 can be directed through the post(s) 1108, in the direction towards the console 1110, but out a vent 1120 located in the posts such that the airflow exhausts at a location over the deck 1114 of the treadmill 1100. In the example shown in FIG. 11, the direction of the air through the vent 1120 in the posts is effected by positioning a damper or airflow damper or diverter 1116 to a first position that blocks air flow through the console.

FIG. 12 depicts an example of an auxiliary fan 1122 located in the posts that forces air out of the vent 1120 in the posts. In this examples, the airflow diverter 1116 is closed off to the vent 1106 in the console 1110, which forces the air out of the posts.

When the airflow diverter 1116 is changed to a second position, such as shown in FIG. 13, airflow generated within the cover 1112 may be directed through the post(s) 1108, into the console 1110, and out a rear facing vent 1106. While the airflow diverter is shown in a specific position, the diverter 1116 may be adjusted to a variety of positions to afford varying levels of airflow above the deck 1114 and blowing out the console.

In some cases, the airflow diverter may be coupled with an actuator to displace the diverter between its various positions. The actuator may be controlled by a user of the treadmill using an input device or mechanism (e.g., 120 of FIG. 1). In other cases, the actuator may be controlled by a program to control the airflow exiting above the deck and onto a user in accordance with a desired exercise program or to correspond with an intensity of the workout experienced by the user (e.g., higher running speeds and/or larger inclines may correspond to a higher airflow from the front vent).

In some cases, the airflow diverter 1116 may be positioned as shown in FIG. 11 upon starting operation of the treadmill, such that all of the airflow initially exhausts through the vent 1120 in the post 1108. A user may then adjust the airflow as desired. In some cases, the airflow diverter may start in the position shown in FIG. 11, and then a control program of the treadmill may alter its position depending on one or more operating characteristics of the treadmill 1100.

In some examples, the console may include a separate fan that is used to direct air towards the user. This fan may pull air from sources outside of the motor housing or other components of the treadmill. For example, this fan may pull air from the ambient environment. As illustrated in FIGS. 11-13, the one or more auxiliary fans 1122 are positioned in the air channel 1102 on each post 1108 and exhausted to the rear of the treadmill 1100 away from a user. Thus, the air pulled by the console fan is taken substantially from the ambient environment, rather than from the air that has been heated from the operation of the treadmill and exhausted through the vent 1120. In some cases, one or more auxiliary fan 1122 may be positioned at other locations in the airflow path to further enhance circulation of the airflow from the area within the cover 1112 up to the vents 1106. Such fans 1122 may be positioned in the posts 1108 in the console, or at any other point within the flow path.

In some cases, the flow path may be directed within the console to cool additional components prior to being exhausted through one or more vents 1106, 1120. For example, the airflow path may traverse a control board, a processor, or other electronic components to remove heat from such components prior to being exhausted from the console.

While the examples above have been described with the outlet being located in the console, the outlet may be located in other areas of the treadmill that are above the deck. For example, outlets may be located within the posts that support the console. Diverters and other components to direct the air flow may direct the air flow out the outlets of the posts and/or console as instructed by the user.

GENERAL DESCRIPTION

In general, various embodiments according to the present disclosure may provide users with an exercise machine that can cool its internal components during the performance of an exercise. In some cases, a workout program may involve raising and lowering the deck. Each time that the deck is moved upwards or downwards, a demand is made on the lift motor. Lift motors are not generally used continuously throughout a workout. Typically, an exercise program performed on a treadmill involves moving the deck to an incline and keeping the deck at that angle for a portion of the workout. The lift motor may generate heat as it is used. Under some conditions, the heat generated in the lift motor degrades the seals, fluids, and other lift motor components. Additionally, after consistent extreme use, a lift motor typically benefits from a period of inactivity to allow for heat dissipation and normalization of the fluids and seals contained in the lift motor. The cooling mechanisms described herein may be used to lower the temperature of the lift motor, thereby extending its ability to operate continually and extending its useful life between maintenance and rebuild.

But, the lift motor may generate heat as it is used. In some cases, when the lift motor increases its temperature, the components around the lift motor may also experience an elevated temperature. Similarly, the other internal components of a treadmill experience periods of increased temperature. Thus, the lift motor may increase the temperature of the exercise machine's other components, and vice-versa, which can negatively impact their performance as well. Under some conditions, the heat generated in the lift motor degrades the seals, fluids, and other lift motor components.

The cooling mechanisms and systems described herein may be used to lower the temperature of the lift motor and/or other components of the treadmill. Additionally, the cooling mechanisms and systems herein may be associated with a flow path that provides cooling of the treadmill.

A treadmill includes a deck which may further include a first pulley located in a front portion of the deck and a second pulley located in a rear portion of the deck. A tread belt may surround the first and second pulleys and provide a surface on which the user may exercise. At least one of the first pulley and the second pulley may be connected to a drive motor so that when the drive motor is active, the pulley rotates. As the pulley rotates, the tread belt moves as well. The user may exercise by walking, running, or cycling on the tread belt's moving surface.

The deck may be capable of having its front portion raised and lowered as well as its rear portion raised and lowered to control the lengthwise slope of the running deck. With these elevation controls, the orientation of the running deck can be adjusted as desired by the user or as instructed by a programmed workout. In those examples where the treadmill is involved with simulating a route that involves changes in elevation, the running deck can be oriented to mimic the elevation changes in the route while the user performs an exercise on the deck.

In one example, the lengthwise slope and/or lateral tilt angle of the deck can be controlled with one or more lift motors. In one example, a single lift motor connects the deck and the exercise machine's base. In this example, when the single lift motor extends a rod, the deck's incline angle increases and when the lift motor retracts the rod, the deck's incline angle decreases.

Any appropriate trigger may be used to cause the lift motor to change the deck's incline angle. In some cases, the incline angle is changed in response to an input from the user, a simulated environment, a programmed workout, a remote device, another type of device or program, or combinations thereof.

In some cases, the exercise machine includes a console attached to an upright structure. In some cases, the upright structure includes a first post adjacent to a first side of the deck and a second post adjacent to a second side of the deck. In this example, the console is supported by the first and second post. The deck moves independently of the first and second posts and also moves independently of the console. In other examples, the posts may move with the deck as the deck's incline angle changes.

The console may locate a display screen and the treadmill's controls within a convenient reach of the user to control the operating parameters of the treadmill. For example, the console may include controls to adjust the speed of the tread belt, adjust a volume of a speaker integrated into the treadmill, adjust an incline angle of the running deck, adjust a decline of the running deck, adjust a lateral tilt of the running deck, select an exercise setting, control a timer, change a view on a display of the console, monitor the user's heart rate or other physiological parameters during the workout, perform other tasks, or combinations thereof. Buttons, levers, touch screens, voice commands, or other mechanisms may be incorporated into the console and can be used to control the capabilities mentioned above. Information relating to these functions may be presented to the user through the display. For example, a calorie count, a timer, a distance, a selected program, an incline angle, a decline angle, a lateral tilt angle, another type of information, or combinations thereof may be presented to the user through the display.

The treadmill may include preprogrammed workouts that simulate an outdoor route. In other examples, the treadmill has the capability of depicting a real world route. For example, the user may input instructions through the control console, a mobile device, another type of device, or combinations thereof to select a course from a map. This map may be a map of real world roads, mountain sides, hiking trails, beaches, golf courses, scenic destinations, other types of locations with real world routes, or combinations thereof. In response to the user's selection, the display of the control console may visually depict the beginning of the selected route. The user may observe details about the location, such as the route's terrain and scenery. In some examples, the display presents a video or a still frame taken of the selected area that represents how the route looked when the video was taken. In other examples, the video or still frame is modified in the display to account for changes to the route's location, such as real time weather, recent construction, and so forth. Further, the display may also add simulated features to the display, such as simulated vehicular traffic, simulated flora, simulated fauna, simulated spectators, simulated competitors, or other types of simulated features. While the various types of routes have been described as being presented through the display of the control console, the route may be presented through another type of display, such as a home entertainment system, a nearby television, a mobile device, another type of display, or combinations thereof.

In addition to simulating the route through a visual presentation of a display, the treadmill may also modify the orientation of the running deck to match the inclines and slopes of the route. For example, if the beginning of the simulated route is on an uphill slope, the running deck may be caused to alter its orientation to raise the front portion of the running deck. Likewise, if the beginning of the simulated route is on a downward slope, the rear portion of the running deck may be caused to elevate to simulate the decline in the route. Also, if the route has a lateral tilt angle, the running deck may be tilted laterally to the appropriate side of the running deck to mimic the lateral tilt angle.

While the programmed workout or the simulated environment may send control signals to orient the deck, the user may, in some instances, override these programmed control signals by manually inputting controls through the console. For example, if the programmed workout or the simulated environment cause the deck to be steeper than the user desires, the user can adjust the deck's orientation with the controls in the console.

Any appropriate type of lift motor may be used in accordance with the principles described herein. For example, a non-exhaustive list of lift motors that may be used includes screw motors, linear actuators, hydraulic motors, pneumatic motors, solenoids, electro-mechanical motors, other types of lift motors, or combinations thereof. Further, the lift motor may be powered with compressed gas, electricity, magnetic fields, other types of power sources, or combinations thereof. Further, the lift motors may also have the ability to laterally tilt the running deck to any appropriate angle formed between a running surface of the running deck and the surface upon which the treadmill rests. For example, the range of the lateral tilt angle may span from negative 55 degrees to positive 55 degrees or any range there between.

Any appropriate type of drive motor may be used to drive the tread belt in a rotational direction. In some examples, the drive motor may be an alternating current motor that draws power from an alternating power source, such as the power circuit of a building. In some cases, the drive motor is a direct current motor. In some of the examples with a direct current motor, the direct current motor draws power from a building power circuit, but the alternating current is converted to direct current.

A flywheel may be connected to a portion of the drive motor so that the flywheel rotates when the drive motor is active. The flywheel may store rotational energy and assist with moving the tread belt at a consistent speed. In some examples, the flywheel has a common rotational axis with the drive motor. In these examples, the flywheel may be connected to the drive motor with an axle. In other situations, the flywheel is attached directly to a side of the drive motor. The flywheel may include any appropriate size, shape, length, width, and weight in accordance with the principles described herein.

The lift motor may operate independent of the drive motor. In some examples, the lift motor may be active when the drive motor is dormant. In other situations, the drive motor may be active when the lift motor is dormant. In some situations, the lift motor and the drive motor may be operated simultaneously, but driven in response to different command sources.

In some cases, the drive motor, flywheel, and the lift motor reside within a common housing. The housing may be incorporated into the deck adjacent to at least one of the motors. In some cases, a lift motor is incorporated in the front portion of the deck, and the housing is located in the front housing of the deck. In other examples, a lift motor is incorporated into a rear portion of the deck, and the housing is incorporated in the rear portion of the deck. In other examples, deck includes a lift motor in the front portion of the deck and in the rear portion of the deck where the elevation of the front and rear portions of the deck can be controlled independently.

As previously noted, the temperature of the lift motor may increase based on continued use or from other causes. A cooling mechanism may be incorporated into the housing to lower the internal temperature of the housing and/or lower the lift motor's temperature. In some examples, the cooling mechanism includes a fan assembly that is attached to the flywheel. The cooling mechanism may be attached to the flywheel by any number of securing methods and systems including, but in no way limited to, adhesive, fasteners, and the like. Alternatively, the cooling mechanism may be formed directly on, or as an integral part of the flywheel. According to this embodiment, the cooling mechanism may be formed on the flywheel via machining, simultaneous casting, metal injection molding, 3-D printing, combinations thereof, and the like.

Any appropriate type of fan assembly may be used in accordance with the principles described in the present disclosure. In one example, the fan assembly includes a ring member that defines a central annulus. The ring member may include a fan face and an attachment face opposite of the fan face. The attachment face may connect to the flywheel, and a fan blade may be formed on the fan face. In some examples, the fan blade includes a geometry that forces air to move in response to the rotation of the ring element. In some cases, the fan blades are protrusions that extend beyond the fan face. These blades may include any appropriate type of shape including, but not limited to, a generally rectangular shape, a generally crescent shape, a generally square shape, another general shape, or combinations thereof. In some cases, the blade generates lift, which causes the high and low pressure regions of the air in the immediate vicinity of the blade as the ring element rotates. In other instances, the blade forces airflow via disruption of space, imparting a force on and causing movement of the air molecules.

In some cases, the ring element includes a lip that protrudes from the fan face's edge and extends away from the fan face in the same direction as the fan blade extends from the fan face. The lip may extend away from the fan face at the same distance as the fan blades. In some cases, the circumferential lip may extend away from the fan face at a greater distance than the fan blade. In yet other examples, the fan blades may extend from the fan face at a greater distance than the lip extends. The lip may contribute to directing the airflow generated by the fan assembly.

In some examples, a low pressure region is generated within the annulus of the ring element when the fan assembly rotates. As a result, air is pulled into the annulus. In those examples where the ring member is attached to the side of the flywheel, the flywheel blocks air from traveling through the annulus which focuses the airflow to the side. The shape of the fan blades may also direct the airflow to the side. The air that is directed to the ring member's side is forced forward of the fan face as the air moves towards the lip attached to the ring's circumferential edge. The lip blocks the air from flowing directly off of the ring element's side. Thus, the airflow that is pulled towards the annulus of the ring member is rerouted to move in an opposing direction. In some cases, the airflow is rerouted approximately 180 degrees. In some examples, the airflow is rerouted between approximately 120 degrees to approximately 175 degrees. The redirected airflow may be contained within the housing. As the redirected airflow travels off of the fan face at an angle, the airflow may generate low pressure regions behind the fan assembly. These low pressure regions may cause air to flow within other regions within the housing, including across the drive motor.

In other examples, the ring member includes a fan face without the circumferential lip. In these examples, the airflow may exit the fan face directly off of the ring member's side. Initial testing shows that those ring members with a circumferential lip on the ring's outer diameter result in a fifty percent noise reduction than those ring members without a circumferential lip.

The lift motor may be located on the fan side of the ring member within the housing. Thus, when the flywheel rotates, the fan assembly may draw in air into the annulus so that air is pulled across the lift motor. As a result, the airflow may remove heat from the lift motor. In other examples, the lift motor may be located elsewhere within the housing and the entire interior of the housing may be lowered as a result of the fan assembly's operation. In some cases, the housing may include vent openings that allow hot air to exit the housing and cool air to be drawn into the housing. The vent openings may be located on an underside of the housing to prevent sweat, liquid, debris, or other substances from falling into the vent holes.

The cooling mechanism as described herein may lower the temperature of the machine's components located within the housing. In particular, the fan assembly may be oriented to generate an airflow across the lift motor to cool the lift motor. Lowering the temperature of the lift motor may reduce the rate of degradation of the lift motor's seals, fluids, and other components. Further, initial testing of cooling mechanisms as described herein have lowered the temperature of the internal housing by approximately 20 degrees Celsius. Another benefit to the cooling mechanism as described herein is the effective temperature differential in a tight space that cannot accommodate bulky or large cooling assemblies.

While the examples above have been described with reference to cooling the lift motor, the cooling mechanism may be used to cool other exercise machine components in addition to or in lieu of the lift motor. For example, some exercise machines may include a printed circuit board with cooling fins. The increased airflow may make the fins of the printed circuit board remove heat more effectively.

In some examples, the load on the drive motor diminishes as the incline of the deck increases. As the incline angle of the deck increases, the user's body weight pushes the tread belt down the length of the deck. In some cases, when the deck's incline angle reaches 12 degrees, the user's body weight is sufficient to drive movement of the tread belt. This can cause the electric motor to operate in reserve causing the motor to generate electricity. The generated electricity can be directed to a dump resistor where the electricity is converted into heat. In examples where the dump resistor is located within the housing, the fan assembly may direct an airflow across the dump resistor to remove the resistor's heat. In some cases, the dump resistor may have a coiled geometry. In other examples, the dump resistor may have a flat geometry with multiple turns. Regardless of the dump resistor's geometry, the increased airflow across the resistor's surface may reduce the resistor's temperature.

In some examples, the flywheel is connected to multiple fan assemblies. For example, a first fan assembly may be connected to a first side of the flywheel, and a second fan assembly may be connected to a second side of the flywheel that is opposite of the first side. The first fan assembly may generate a first airflow that causes air to pass through the lift motor while the second fan assembly may generate a second airflow that causes air to pass through the drive motor which may lower the temperature of the drive motor. In other examples, additional fan assemblies may be connected to the flywheel with an axle. In this type of example, the fan assemblies may be connected in series and be spaced apart from each other.

In some cases, the fan assembly is attached to the flywheel. In other examples, the fan assembly is integrally formed in the flywheel. Further, in some cases, the fan assembly is attached to the side of the flywheel. In yet other examples, the fan assembly is disposed about the circumference of the flywheel.

In some examples, the fan assembly may be a centrifugal fan where the fan assembly includes an impeller that includes a series of blades. The fan assembly blows air at right angles to the intake of the fan through a centrifugal force.

In some examples, a clutch mechanism may be installed between the flywheel and the fan, enabling selective disengagement of the fan from the flywheel. Thus, even though the flywheel may be rotating, if the clutch is not engaged, the fan will not rotate with the flywheel. In some embodiments, the clutch may include an electromagnetic clutch. In some embodiments, the clutch may be configured in a "normally engaged" status, meaning that the fan is engaged with the flywheel and rotates with the flywheel when operation of the treadmill is started. The clutch may then stay in the engaged status until it is selectively disengaged.

Any appropriate trigger may be used to cause disengagement of the clutch. In some cases, the clutch is disengaged in response to an input from the user, a simulated environment, a programmed workout, a remote device, another type of device or program, or combinations thereof. Likewise, any appropriate trigger, such as those noted above, may be used to cause reengagement of the clutch.

An airflow path may be provided from the area associated with the fan (e.g., the area within the shroud or cover and associated with the drive motor and/or lift mechanism) to exhaust the airflow to a desired location. In some embodiments, an airflow path may be provided from a location adjacent a fan assembly to the console, and through one or more exhaust or outlet vents. In some embodiments, an exhaust vent may be configured to direct some or all of the airflow exhaust to a location directly above the deck of the treadmill to blow on, and cool, a user of the treadmill.

In some embodiments, multiple exhaust vents may be utilized. An airflow diverter may be used to proportion the amount of airflow exhausting from each vent. In some embodiments, the airflow diverter may be used to selectively and completely divert the airflow solely to any one of the exhaust vents. For example, when the airflow diverter is in one selected position, it may direct all airflow such that exhausts above the treadmill deck as noted above. When the airflow diverter is in a second position, it may direct a portion of the airflow above the deck, and direct a portion to another location (not above the deck) and away from the user. When the airflow diverter is in a third position, it may direct all airflow to exhaust to a location away from the deck and user of the treadmill. The flow diverter may be infinitely adjustable to provide a variety of adjustment levels to the airflow exhausting above the deck.

In some embodiments, the cooling system, including software instructions, is arranged such that the auxiliary fan runs and all of the airflow is exhausted through the back side of the console above the deck upon starting operation of the treadmill. Thus, the diverter may be initially positioned, upon each operational start of the treadmill, to divert all airflow through one or more exhaust vents to a location above the deck away from the user. A user may then manually adjust the diverter to alter the airflow if desired. Alternatively, or additionally, other triggers may alter the position of the diverter after operation of the treadmill has started. Such triggers may include, for example, a simulated environment, a programmed workout, a remote device, another type of device or program, or combinations thereof.

In some embodiments, the airflow channel may include a pathway through one or more posts of the treadmill up to the console. In some embodiments, inlet vents may be placed in the posts, or at any other location along the airflow path, to enable ambient air to be drawn into the airflow channel and mix with air that is being drawn across the lift motor, drive motor or other related components. The mixture of ambient air may provide some cooling to the air drawn from within the shrouded or covered area prior to exhausting through the back side of the console.

In some embodiments, one or more auxiliary fans, such as an electric fan, may be placed at another location within the airflow path. For example, an auxiliary fan may be placed in a post (or one in each post), within the console, or at some other location. The auxiliary fan may be configured to operate in conjunction with the fan assembly coupled with the flywheel (e.g., turn on when the clutch is engaged, and off when the clutch is disengaged), or operate independent from the fan assembly. In one embodiment, the auxiliary fan or fans may be configured to start when the treadmill is started by a user for operation. In some embodiments, a user may then manually turn off the auxiliary fan(s). Alternatively, or additionally, other triggers may alter the operation of the auxiliary fan(s) after operation of the treadmill has started. Such triggers may include, for example, a simulated environment, a programmed workout, a remote device, another type of device or program, or combinations thereof.

In some embodiments, the airflow path may be defined to provide cooling to additional components of the treadmill. For example, the airflow path may be arranged such that air flows over, and provides cooling to, control boards, processors, displays, or other electronic components, including those associated with the console.

While the examples above describe a cooling mechanism that can be used in relation to a treadmill, the cooling mechanism may be used in any appropriate type of exercise machine. For example, the fan assembly may be attached to the flywheel of a resistance mechanism. In these types of examples, the resistance mechanisms may be incorporated into stationary bikes, elliptical trainers, rowing machines, or other types of exercise machines. The fan assemblies may be used to cool the components of the exercise machine. These component may include motors, lift motors, dump resistors, electronics, bearings, sensors, other types of components, or combinations thereof.

The description herein is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not limited to the examples described herein, but is to be accorded the broadest scope consistent with the principles and novel features disclosed herein.

What is claimed is:

1. A method for cooling a motor on a treadmill, comprising:

rotating a flywheel with a drive motor;

rotating a fan assembly coupled to flywheel;

generating a pressure drop at the fan assembly between the drive motor and a lift motor; and drawing intake air in a first direction across the lift motor toward the pressure drop.

2. The method of claim 1, wherein drawing the intake air in the first direction includes cooling the lift motor.

3. The method of claim 1, wherein generating the pressure drop includes rotating at least one fan blade of the fan assembly.

4. The method of claim 3, wherein the fan assembly is a first fan assembly and the intake air is a first flow of air, and further comprising:

rotating a second fan assembly on the flywheel opposite the first fan assembly; and drawing a second flow of air toward the second fan assembly across the drive motor.

5. The method of claim 1, further comprising redirecting the intake air in a second direction at a distal circumference of the fan assembly.

6. The method of claim 5, wherein the intake air is redirected by a circumferential lip on the distal circumference of the fan assembly.

7. A method for cooling a treadmill, comprising:

changing a height of a deck with a lift motor, lift motor generating heat;

cooling the lift motor by:

rotating a fan assembly on a flywheel coaxial with a drive motor; and drawing air toward the fan assembly across the lift motor; and diverting the air to an exhaust vent.

8. The method of claim 7, wherein diverting the air includes exhausting the air over the deck.

9. The method of claim 7, wherein diverting the air includes directing the air through an air channel located in a post.

10. The method of claim 7, wherein diverting the air includes changing a position of an air diverter to change a flow path of the air.

11. The method of claim 7, wherein diverting the air includes pulling the air with an auxiliary fan in a flow path of the air.

12. The method of claim 7, wherein diverting the air includes flowing air across electronics in a console.

13. The method of claim 7, wherein diverting the air includes diverting the air away from a user operating the treadmill.

14. A method for operating a cooling mechanism, comprising:

rotating a fan assembly with a drive motor;

drawing air in a first direction across a lift motor;

directing the air toward a distal edge of the fan assembly; and rerouting the air from the first direction to a second direction at a circumferential lip on the distal edge of the fan assembly.

15. The method of claim 14, further comprising disengaging the fan assembly with a clutch assembly.

16. The method of claim 15, wherein disengaging the fan assembly includes disengaging the fan assembly based on an input from a user.

17. The method of claim 14, wherein drawing the air in the first direction includes drawing the air from the lift motor toward the fan assembly and the drive motor.

18. The method of claim 14, wherein the second direction is between 120° and 175° of the first direction.

19. The method of claim 14, wherein rerouting the air from the first direction to the second direction includes reducing noise generated by a flow of the air by about 50%.

* * * * *